US011618022B2

(12) United States Patent
Dubay et al.

(10) Patent No.: US 11,618,022 B2
(45) Date of Patent: Apr. 4, 2023

(54) MICROFLUIDIC ACOUSTIC SEPARATION DEVICES

(71) Applicant: The Charles Stark Draper Laboratory, Inc., Cambridge, MA (US)

(72) Inventors: Ryan Dubay, Cambridge, MA (US); Jason Fiering, Cambridge, MA (US); Rebecca Christianson, Cambridge, MA (US); Jason Durant, Cambridge, MA (US); Charles Lissandrello, Cambridge, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 476 days.

(21) Appl. No.: 16/839,365

(22) Filed: Apr. 3, 2020

(65) Prior Publication Data

US 2020/0316601 A1 Oct. 8, 2020

Related U.S. Application Data

(60) Provisional application No. 62/829,407, filed on Apr. 4, 2019.

(51) Int. Cl.
*B01L 3/00* (2006.01)

(52) U.S. Cl.
CPC ..... *B01L 3/502761* (2013.01); *B01L 3/50273* (2013.01); *B01L 2200/0652* (2013.01); *B01L 2300/0864* (2013.01); *B01L 2400/0436* (2013.01)

(58) Field of Classification Search
None
See application file for complete search history.

(56) References Cited

U.S. PATENT DOCUMENTS

2004/0069717 A1 4/2004 Laurell et al.
2017/0241878 A1* 8/2017 Broyer et al. .... B01L 3/502776
2018/0361053 A1* 12/2018 Fiering et al. ..... B01D 21/283
2019/0056302 A1 2/2019 Berezin et al.

FOREIGN PATENT DOCUMENTS

WO WO-2018200652 A1 * 11/2018 ..... A61M 1/365
WO WO-2018/236708 A1 12/2018

OTHER PUBLICATIONS

Extended European Search Report on EP Appl. Ser. No. 20167925.5 dated May 25, 2020 (8 pages).

* cited by examiner

*Primary Examiner* — Kaijiang Zhang
(74) *Attorney, Agent, or Firm* — Foley & Lardner LLP

(57) ABSTRACT

A microfluidic system can include a substrate comprising an elastic material and defining a microfluidic channel. The substrate can have a first set of dimensions defining a thickness of a wall of the microfluidic channel and a second set of dimensions defining a width of the microfluidic channel. A transducer can be mechanically coupled with the substrate. The transducer can be operated at a predetermined frequency different from a primary thickness resonant frequency of the transducer. A thickness and a width of the transducer can be selected based on the first set of dimensions defining the thickness of the wall of the microfluidic channel and the second set of dimensions defining the width of the microfluidic channel.

19 Claims, 20 Drawing Sheets

MICROFLUIDIC ACOUSTIC SEPARATION DEVICES

CROSS-REFERENCE TO RELATED APPLICATION

This application claims priority to U.S. Provisional Application No. 62/829,407, filed on Apr. 4, 2019 and titled "MICROFLUIDIC ACOUSTIC SEPARATION DEVICES," which is incorporated by reference in its entirety.

BACKGROUND OF THE DISCLOSURE

Acoustic forces can be used as a method to manipulate cells and other particles within fluid samples. For example, the acoustic forces may be used to separate cells of one type from another. Silicon-, glass-, or metal-based device can be used; however, these devices may be expensive and slow to manufacture and can have poor compatibility with many biological samples.

SUMMARY OF THE DISCLOSURE

The acoustic separation device described herein can include one or more transducers that can impart a standing acoustic wave across microfluidic channels within an elastic material-based substrate, such as a plastic- or polymer-based substrate. The dimensions of the transducer can be selected based on (or in concert with) the dimensions of the substrate and the microfluidic channels defined therein. The dimensions (e.g., the thickness, length, and width) of the transducer can affect the frequencies at which the transducer can exhibit resonances or modes. Depending on the operating frequency and corresponding mode, the transducer can oscillate with spatial variation along the length and/or width of the transducer. The oscillations can cause displacement nodes to form along the length and/or width of the transducer. The microfluidic channels can be aligned with the displacement nodes of the transducer. Alignment of the microfluidic channels with the displacement nodes of the transducer can improve energy transfer from the transducer to the fluid within the microfluidic channel and provide for a more efficient acoustic separation device.

At least one aspect of this disclosure is directed to a microfluidic system. The system can include a substrate comprising an elastic material and defining a microfluidic channel. The substrate can have a first set of dimensions defining a thickness of a wall of the microfluidic channel and a second set of dimensions defining a width of the microfluidic channel. The system can include a transducer mechanically coupled with the substrate. The transducer can be operated at a predetermined frequency different from a primary thickness resonant frequency of the transducer to excite the substrate in a predetermined oscillatory mode to impart an acoustic wave onto a fluid contained in the microfluidic channel defined by the substrate. A thickness and a width of the transducer can be based on the first set of dimensions defining the thickness of the wall of the microfluidic channel and the second set of dimensions defining the width of the microfluidic channel.

In some implementations, the transducer can be configured to form a displacement node at a first location along an axis parallel to a surface of the transducer. The position of the first location can be based on the thickness and the width of the transducer. In some implementations, the transducer can be configured to form a plurality of displacement nodes at a plurality of locations along an axis parallel to a surface of the transducer.

In some implementations, a symmetry axis of the microfluidic channel can be aligned with a displacement node of the transducer. In some implementations, the wall can be aligned with a displacement node of the transducer. In some implementations, the transducer can be configured to form a displacement node at a first location based on the at least one of the thickness or the width of the transducer.

In some implementations, the system may not include a second transducer mechanically coupled with the substrate. In some implementations, the system may not include a rigid reflector aligned with a sidewall of the microfluidic channel.

In some implementations, the system can further include an adhesive coupling a face of the substrate with the transducer. In some implementations, the adhesive can be patterned to form a gap below a portion of the face of the substrate. An edge of the gap can be aligned with a symmetry axis of the microfluidic channel or with a sidewall of the microfluidic channel.

In some implementations, a material of the transducer can be selected based on the first set of dimensions defining the thickness of the wall of the microfluidic channel and the second set of dimensions defining the width of the microfluidic channel.

At least another aspect of this disclosure is directed to a microfluidic system. The system can include a substrate defining a microfluidic channel. The system can include a transducer mechanically coupled with a portion of the substrate. The transducer can be configured to excite the substrate to impart an acoustic wave onto a fluid contained in the microfluidic channel defined by the substrate. The system can include an adhesive layer to mechanically couple the transducer with the portion of the substrate. The adhesive layer can be patterned to define a coupling region that couples the transducer with the substrate and an uncoupled region in which a gap exists between the transducer and the substrate.

In some implementations, the adhesive layer can be patterned to define a shape selected based on a resonant mode of the substrate.

In some implementations, the coupling region can be aligned along a first side of a central axis of the microfluidic channel defined by the substrate, and the uncoupled region can be aligned along a second side of the central axis of the microfluidic channel defined by the substrate, opposite the first side of the central axis.

In some implementations, the coupling region can include a first coupling region aligned along a first side of a central axis of the microfluidic channel defined by the substrate and a second coupling region aligned along a second side of the central axis of the microfluidic channel defined by the substrate, opposite the first side of the central axis. The uncoupled region can be aligned along the central axis of the microfluidic channel and is positioned between the first coupling region and the second coupling region.

In some implementations, the adhesive layer can include at least one of a sugar, pectin, gelatin, agar, a hydrogel, glycerol, a wax, a tape, or a polyethylene glycol. In some implementations, the adhesive layer can include a pressure sensitive adhesive material. In some implementations, the adhesive layer can be patterned using at least one of stencil printing, screen printing, laser machining, or die cutting.

In some implementations, the system can include at least one alignment pin positioned on at least one of the substrate or the transducer. The alignment ping can be configured to align the substrate with respect to the transducer.

At least another aspect of this disclosure is directed to a method. The method can include defining a microfluidic channel in a substrate comprising an elastic material. The substrate can have a first set of dimensions defining a thickness of a wall of the microfluidic channel. The method can include selecting a transducer to operate at a predetermined frequency different from a primary thickness resonant frequency of the transducer to excite the substrate in a predetermined oscillatory mode to impart an acoustic wave onto a fluid contained in the microfluidic channel defined by the substrate, based on the first set of dimensions defining the thickness of the wall of the microfluidic channel. The method can include coupling at least a portion of the substrate with a surface of the transducer.

In some implementations, the method can include aligning a symmetry axis of the microfluidic channel with a displacement node of the transducer. In some implementations, the method can include activating the transducer in a bending mode. In some implementations, the method can include applying an electrical signal to the transducer at the predetermined frequency to form a displacement node at a first location along an axis parallel to the surface of the transducer.

In some implementations, the method can include defining a gap in an adhesive layer. The method can also include aligning the gap with a portion of the microfluidic channel. The method can also include coupling the substrate with the surface of the transducer via the adhesive layer. In some implementations, the adhesive layer can include at least one of a sugar, pectin, gelatin, agar, a hydrogel, glycerol, a wax, or polyethylene glycol.

At least another aspect of this disclosure is directed to a method. The method can include defining a microfluidic channel in a substrate. The method can include selecting a transducer to excite the substrate to impart an acoustic wave onto a fluid contained in the microfluidic channel defined by the substrate. The method can include patterning a layer of adhesive material to define a coupling region for coupling the transducer with the substrate and an uncoupled region in which a gap exists between the transducer and the substrate. The method can include coupling the substrate with the transducer via the patterned layer of adhesive material.

In some implementations, the method can include patterning the layer of adhesive material to define a shape selected based on a resonant mode of the substrate. In some implementations, the method can include patterning the layer of adhesive material using at least one of stencil printing, screen printing, laser machining, or die cutting. In some implementations, the method can include coupling the substrate with the transducer using at least one of hand pressure, a mechanical press, or a clamp. In some implementations, the method can include applying at least one of water, a solvent, electrostatic charge, plasma treatment, or a gas phase treatment to at least one of the substrate or the transducer, prior to coupling the substrate with the transducer.

According to at least one aspect of the disclosure, an acoustic separation system can include a microfluidic channel. The microfluidic channel can be defined within at least one polymer substrate. The at least one polymer substrate can have a first set of dimensions that can define a thickness of a wall of the microfluidic channel. The system can include a transducer to impart an acoustic wave onto the microfluidic channel defined within the at least one polymer substrate. At least one of a thickness or a width of the transducer can be based on the first set of dimensions defining the thickness of the wall of the microfluidic channel.

In some implementations, the transducer can be configured to form a displacement node at a first location along an axis parallel to a surface of the transducer. A position of the first location can be based on the thickness and the width of the transducer. The transducer can be configured to form a plurality of displacement nodes at a plurality of locations along an axis parallel to a surface of the transducer. A symmetry axis of the microfluidic channel can be aligned with a displacement node of the transducer. In some implementations, the wall can be aligned with a displacement node of the transducer.

The transducer can be configured to form a displacement node at a first location based on the at least one of the thickness, length, or the width of the transducer. The system can include an adhesive coupling the polymer substrate with the transducer. The adhesive can include a gap below a portion of the microfluidic channel. An edge of the gap can be aligned with a symmetry axis of the microfluidic channel. An edge of the gap can be aligned with a face of a wall of the microfluidic channel. The adhesive can include at least one of a sugar, pectin, gelatin, agar, a hydrogel, glycerol, a wax, or polyethylene glycol, or a conventional pressure-sensitive adhesive (e.g. a tape).

According to at least one aspect of the disclosure, a method can include defining a microfluidic channel in at least one polymer substrate. The at least one polymer substrate can have a first set of dimensions that can define a thickness of a wall of the microfluidic channel. The method can include selecting a transducer to impart an acoustic wave across the microfluidic channel defined within the at least polymer substrate based on the first set of dimensions defining the thickness of the wall of the microfluidic channel. The method can include coupling at least a portion of the at least one polymer substrate with a surface of the transducer.

The method can include aligning a symmetry axis of the microfluidic channel with a displacement node of the transducer. The method can include activating the transducer in a bending mode. The method can include applying an electrical signal to the transducer at a predetermined frequency to form a displacement node at a first location along an axis parallel to the surface of the transducer.

The method can include defining a gap in an adhesive layer, aligning the gap with a portion of the microfluidic channel, and coupling the at least one polymer substrate to the surface of the transducer with the adhesive layer. The adhesive can include at least one of a sugar, pectin, gelatin, agar, a hydrogel, glycerol, a wax, or polyethylene glycol.

According to at least one aspect of the disclosure, a method can include providing an acoustic transducer to impart an acoustic wave across a microfluidic channel. The microfluidic channel can be defined within at least one polymer substrate. The transducer can have at least one of a thickness or a width based on a first set of dimensions defining a thickness of a wall of the microfluidic channel. The acoustic transducer can be configured to generate one or more displacement nodes along an axis of the acoustic transducer parallel to a surface of the acoustic transducer.

The acoustic transducer can include a lead zirconate titanate substrate. The acoustic transducer can include a patterned adhesive layer coupled with the surface of the acoustic transducer.

The foregoing general description and following description of the drawings and detailed description are exemplary and explanatory and are intended to provide further explanation of the invention as claimed. While the device may be described as a separator or separation device in some instances, the device can be used for concentration, washing, or similar manipulation of particles, cells, exosomes, or debris suspended in a fluid. Other objects, advantages, and novel features will be readily apparent to those skilled in the art from the following brief description of the drawings and detailed description.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. In the drawings.

DETAILED DESCRIPTION

Figure 1:
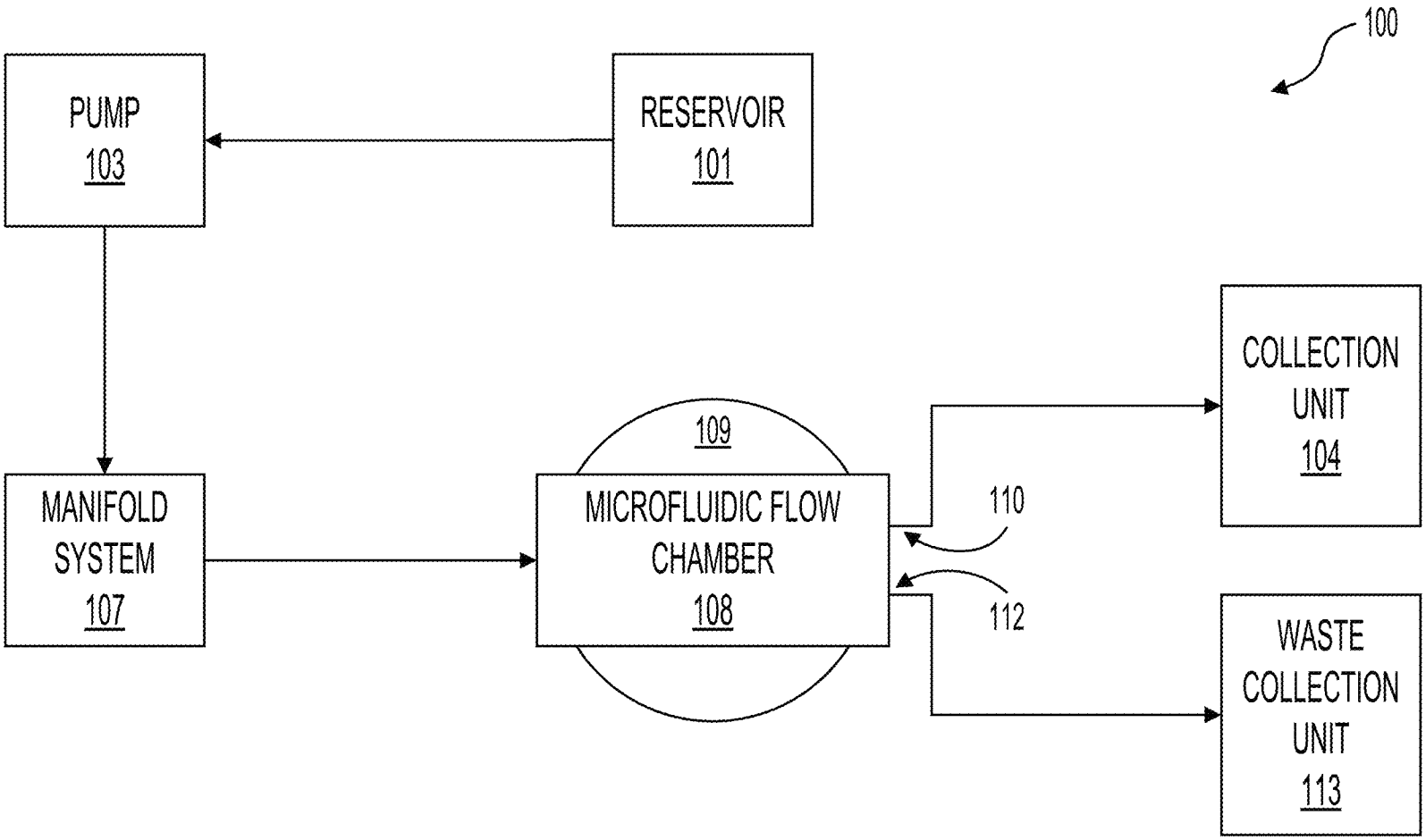
FIG. 1 illustrates an example system for cleansing, separating, washing, or concentrating particles in a fluid.

The various concepts introduced above and discussed in greater detail below may be implemented in any of numerous ways, as the described concepts are not limited to any particular manner of implementation. Examples of specific implementations and applications are provided primarily for illustrative purposes.

The present disclosure describes an acoustic separation device and a method for designing and manufacturing the acoustic separation device. The acoustic separation device can be a microfluidic flow chamber that includes one or more microfluidic channels. A transducer of the acoustic separation device can impart acoustic waves across the microfluidic channels to form pressure nodes (and anti-nodes) within the microfluidic channels of the acoustic separation device. The pressure generated by the acoustic waves can drive the particles within a fluid flowing through the microfluidic channels towards the pressure nodes (or anti-nodes). The microfluidic flow chamber can be manufactured from an elastic material, such as a polymer. The configuration (e.g., the dimensions) of the microfluidic flow chamber and the configuration (e.g., dimensions and operating frequency) of the transducer can be co-designed to improve the interplay of the transducer and the microfluidic flow chamber, thereby improving the efficiency of the acoustic separation device. The efficiency of the acoustic separation device can be based on the force applied to the particles in the fluid by the imparted acoustic waves. For example, an acoustic separation device with relatively high efficiency enables relatively more acoustic energy to be transferred into the fluid relative to the acoustic energy in the walls of the microfluidic flow chamber to provide a relatively higher force on the particles in the fluid.

The transducers described below can be configured to operate with microfluidic flow chambers with relatively elastic materials. The dimensions of the transducer can be selected based on (or in concert with) the dimensions of the microfluidic flow chamber. The dimensions (e.g., the thickness, length, and width) of the transducer, the materials of its composition, and its mounting conditions can affect the frequencies at which the transducer can exhibit resonances or modes. Depending on the operating frequency and corresponding mode, the transducer can oscillate with spatial variation along the length and/or width of the transducer. The oscillations, or "mode shapes" can cause displacement nodes to form along the length and/or width of the transducer. The microfluidic channels can be aligned with the displacement nodes of the transducer. Alignment of the microfluidic channels with the displacement nodes of the transducer can improve energy transfer from the transducer to the fluid within the microfluidic channel and provide for a more efficient acoustic separation device.

The microfluidic channels of the microfluidic flow chamber can be aligned with the nodes such that the transducer exerts asymmetrical forces on opposing walls of the microfluidic channels. Polymer based microfluidic flow chambers can have lower acoustic impedance when compared to microfluidic flow chambers manufactured from rigid materials such as glass, silicon, or metal. The polymer based microfluidic flow chambers can resonate at a greater number of frequencies when compared to the rigid microfluidic flow chambers. The greater number of resonant frequencies (or resonant modes) of the polymer based microfluidic flow chambers enable the activation of the flow chamber at any of multiple frequencies. The polymer based microfluidic flow chamber can be activated at a frequency that increases efficiency of the energy transfer from the microfluidic flow chamber to the fluid within the microfluidic flow chamber. The increased efficiency can occur when the transducer has a mode at a frequency that is also an efficient resonant frequency of the microfluidic flow chamber. In some implementations, increased efficiency can include when the transducer mode is operated at a higher order mode or a bending mode that can result in displacement nodes along the transducer's length or width.

In some implementations, an adhesive material that joins the substrate defining the microfluidic channel or flow chamber to the transducer can be patterned to remove at least a portion of the material of the adhesive layer between the two devices. As a result, the adhesive material may couple the transducer with the substrate in one or more coupling regions, while one or more uncoupled regions may exist in which a gap (e.g., an air gap or a vacuum) is positioned between the transducer and the substrate. Due to the gap, the total acoustic power transferred from the transducer to the substrate may be reduced. However, in some implementations the shape and position of the coupling region and the uncoupled region can be selected such that device performance (e.g., separation capability) is improved, relative to a device in which the substrate and the transducer are joined by a complete layer of adhesive material that is not patterned. For example, by patterning the adhesive layer such that only selected portions (e.g., the coupling region) of the substrate are joined with the oscillating transducer, the substrate may be more efficiently excited in a resonant oscillatory mode. In some implementations, the substrate may be excited in a rocking mode.

FIG. 1 illustrates a system 100 for purifying cells or for cleansing fluid by removing waste material such as bacteria, viruses, or toxins (which can be generally referred to as particles) using acoustic separation. In the system 100, fluid can be pumped from a reservoir 101 via a line by a first pump 103. The pump 103 can pump the fluid into a manifold system 107. The manifold system 107 can distribute the fluid into a plurality of microfluidic channels contained within the microfluidic flow chamber 108. The microfluidic flow chamber 108 can sit atop at least one bulk piezoelectric acoustic transducer 109, which can be referred to as a transducer 109. The acoustic waves generated by the transducer 109 can focus the suspended contents of the fluid (e.g., the particles) toward specific axes of the microfluidic channels and toward outlets of the separation channels. For example, a cleansed portion of the fluid (e.g., fluid with the particles substantially removed) can flow to a first outlet 110. After exiting the first outlet 110, the cleansed fluid can be deposited into a collection unit 104. The particles (and other waste material) removed from the fluid can exit the microfluidic flow chamber 108 via a second outlet 112 and be deposited into a waste collection unit 113.

The system 100 can include pumps 103 for moving fluid from the reservoir 101 to the microfluidic flow chamber 108 and then to one of the collection unit 104 or the waste collection unit 113. The pump 103 can operate continuously or intermittently. For example, the pump 103 can be activated when a level of fluid in the manifold system 107 falls below a set threshold. The flow rate of the pump 103 is configurable. Example pumps 103 can include, but are not limited, to peristaltic pumps, syringe pumps, or any other pump suitable for flowing fluid. The system can include a plurality of pumps 103. For example, the system 100 could include one or more additional pumps 103 between the microfluidic flow chamber 108 and the collection unit 104 and the waste collection unit 113.

The system 100 can include one or more manifold systems 107 that flow the fluid from the pump 103 or reservoir 101 to each inlet of the microfluidic channels within the microfluidic flow chamber 108. As described below, the microfluidic flow chamber 108 can contain a plurality of microfluidic channels. The manifold system 107 can include a plurality of biomimetic branching structures that gradually branch from the input of the manifold system 107 to a plurality of outputs that interface with the inputs of the microfluidic channels within the microfluidic flow chamber 108. The manifold system 107 can be configured to reduce the shear force exerted on the fluid as the channels within the manifold system 107 branch from an inlet to a plurality of outlets.

As the fluid (and particles therein) flow through the microfluidic flow chamber 108, the particles within the fluid can be driven, with a standing acoustic wave, toward nodes formed by the standing acoustic wave. The transducer 109 can be configured to generate the nodes at predetermined locations within the microfluidic channels. The nodes can be aligned with outlets of the microfluidic channels. For example, a first node can be aligned with a waste outlet of the microfluidic channels, which can feed waste fluid out of the microfluidic flow chamber 108 through the outlet 112 and to the waste collection unit. An antinode can be aligned with a filtered outlet of the microfluidic channels, which can feed purified fluid out of the microfluidic flow chamber 108 through the outlet 110 and to the collection unit 104. The transducer 109 can generate a plurality of nodes (or the system can include a plurality of transducers 109 that generate a plurality of nodes) to remove the particles from the fluid over a plurality of stages. In some implementations, the system 100 can remove the particles with a single stage.

As shown in the illustrations of system 100, the microfluidic flow chamber 108 sits atop one or more a transducers 109. The transducers 109 can be a bulk piezoelectric transducer. In some implementations, the system 100 contains a single transducer 109, while in other implementations the system 100 contains a plurality of transducers 109. The microfluidic flow chamber 108 can be coupled with the transducer 109. The coupling of the microfluidic flow chamber 108 with the transducer 109 is described further in relation to FIGS. 2-6, among others. The transducer 109 is described further in relation to FIGS. 2-13, among others. In some implementations, the transducer 109 can be reusable or disposable. The microfluidic flow chamber 108 can be reusable or disposable. For example, the microfluidic flow chamber 108 can be disposable and the transducer 109 reusable such that after a use the microfluidic flow chamber 108 can be decoupled from the transducer 109 and disposed and the transducer 109 can be used with a new microfluidic flow chamber 108.

As described herein, the transducer 109 can impose a standing acoustic wave on the separation channels of the microfluidic flow chamber 108 transverse to the flow of the fluid within the microfluidic flow chamber 108. The standing acoustic waves can drive particles towards or away from the walls of the separation channels or other aggregation axes.

As described further below, the operation of the transducer 109 and the coupling of the microfluidic flow chamber 108 with the transducer 109 can be configured to control or otherwise effect the acoustic focusing within the microfluidic channels of the microfluidic flow chamber 108. The transducer 109 can be a durable component that can be reused. The adhesive coupling of the transducer 109 with the microfluidic flow chamber 108 can have predetermined properties, such as thermal conductivity, electrical conductivity/resistivity, mechanical elasticity, acoustic impedance, dimensional tolerance, and thickness. The adhesive can enable the microfluidic flow chamber 108 to be coupled to the transducer 109 and then decoupled from the transducer 109 without damaging the transducer 109. The adhesive can also be patterned such that certain regions of the microfluidic flow chamber 108 are coupled with the transducer 109 while other regions of the microfluidic flow chamber 108 are not coupled with the transducer 109.

Figure 2:
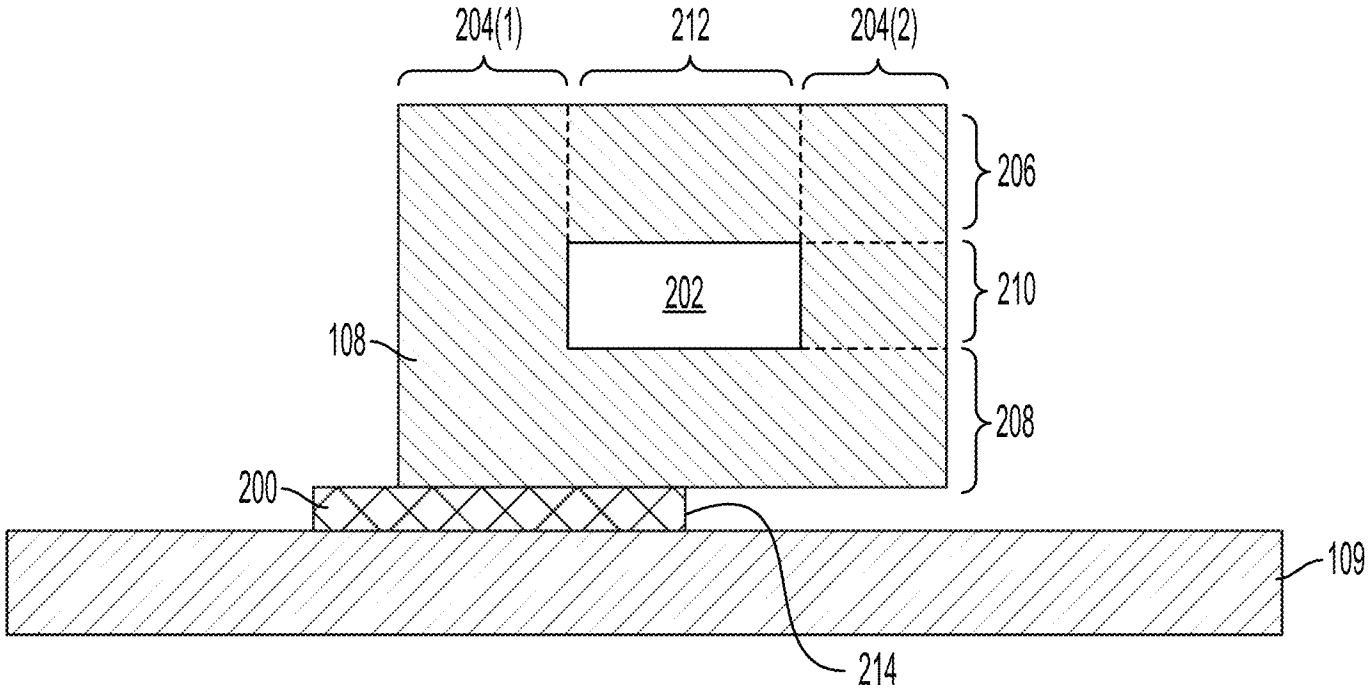
FIGS. 2 and 3 illustrate example microfluidic flow chambers coupled with a transducer that can be used in the system illustrated in FIG. 1.

FIG. 2 illustrates an example of coupling a microfluidic flow chamber 108 to a transducer 109. In some implementations, coupling of the microfluidic flow chamber 108 with the microfluidic flow chamber 108 can be controlled to affect the transmission of acoustic waves from the transducer 109 to the microfluidic flow chamber 108. The microfluidic flow chamber 108 can be coupled with the transducer 109 by an adhesive 200. The microfluidic flow chamber 108 can form wall 204(1) and wall 204(2) (which can generally be referred to as walls 204) of the microfluidic channel 202. The microfluidic flow chamber 108 can form the ceiling 206 and the floor 208 of the microfluidic channel 202. In some implementations, the ceiling 206 and the floor 208 can also be referred to as walls. The microfluidic channel 202 can have a width 212 and a height 210. The microfluidic flow chamber 108 can include one or more polymer substrates or be molded or fabricated from polymer materials.

The system 100 can include an adhesive 200 that can couple the microfluidic flow chamber 108 with the transducer 109. The adhesive 200 can be patterned such that portions of the microfluidic flow chamber 108 can be coupled with the transducer 109 while other portions of the microfluidic flow chamber 108 are not coupled with the transducer 109. For example, as illustrated in FIG. 2, an edge 214 of the adhesive 200 can be aligned with the center of the microfluidic channel 202. Aligning the edge 214 of the adhesive 200 with the center of the microfluidic channel 202 results in half of microfluidic flow chamber 108 being coupled with the transducer 109 and half of the microfluidic flow chamber 108 being uncoupled with the transducer 109. The edge 214 can be aligned with the center of the microfluidic channel 202, with a face of the microfluidic channel 202 formed by the wall 204(1), with a face of the microfluidic channel 202 formed by the wall 204(2), or with a portion of one of the walls 204(1).

The adhesive 200 can join the transducer 109 with the microfluidic flow chamber 108 in a coupling region (e.g., the left hand side of FIG. 2), while an uncoupled region may exist in which a gap is positioned between the transducer 109 with the microfluidic flow chamber 108 (e.g., the right hand side of FIG. 2). It should be appreciated that the shape and position of the coupling region and uncoupled region can be varied in other implementations. For example, in some implementations, the adhesive 200 can be patterned to remove at least about 50% of the material underlying the surface area of the flow chamber 108, so that the uncoupled region accounts for about half of the surface area of the bottom surface of the microfluidic flow chamber 108, while the coupling region accounts for the other half. In some other implementations, the adhesive 200 can be patterned to remove at least about 10%, about 20%, about 30%, about 40%, about 60%, about 70%, about 80%, or about 90% of the material underlying the surface area of the flow chamber 108, so that the uncoupled region accounts for those respective percentages of the surface area of the bottom surface of the microfluidic flow chamber 108. Other shapes for the coupled region and uncoupled region are described further below.

The adhesive 200 can have predetermined acoustic impedance properties and predetermined thermal conductivity properties. For example, the adhesive 200 can have relatively high acoustic impedance and thermal conductivity. The acoustic impedance can be between about 0.5 Mrayl and about 5 Mrayl, between about 0.5 Mrayl and about 4 Mrayl, between about 1 Mrayl and about 4 Mrayl, or between about 2 Mrayl and about 3 Mrayl. The thermal conductivity of the adhesive 200 can be between about 0.1 W/(m*k) and about 1 W/(m*k), between about 0.1 W/(m*k) and about 0.75 W/(m*k), between about 0.1 W/(m*k) and about 0.5 W/(m*k), between about 0.15 W/(m*k) and about 0.5 W/(m*k), between about 0.2 W/(m*k) and about 0.5 W/(m*k), between about 0.2 W/(m*k) and about 0.4 W/(m*k), or between about 0.2 W/(m*k) and about 0.3 W/(m*k). The adhesive 200 can include a pressure sensitive adhesive. The adhesive 200 can include, tapes, gels, or materials that may be coated or coated onto a surface of the transducer 109. The transducer 109 can include one or more sugars (e.g., fructose or glucose), pectin, gelatin, agar, hydrogels, glycerol, alkanes (e.g., waxes), polyethylene glycol, epoxy, cyanoacrylate glues, or any combination thereof. In some implementations, the adhesive 200 can be soluble, washable with water or other solvents, or otherwise removable from the transducer 109 or microfluidic flow chamber 108. For example, the adhesive 200 can be at least partially dissolved with a solvent to enable the microfluidic flow chamber 108 to be removed or decoupled from the transducer 109 without damaging the transducer 109. The adhesive 200 can be heat or light sensitive. For example, exposure to heat or UV light can reduce the adhesive properties of the adhesive 200 such that the microfluidic flow chamber 108 and adhesive 200 can be separated. The adhesive 200 can be between about 5 μm and about 200 μm, between about 10 μm and about 150 μm, between about 25 μm and about 150 μm, between about 25 μm and about 100 μm, between about 25 μm and about 75 μm, or between about 25 μm and about 50 μm thick.

The adhesive 200 can be patterned onto the transducer 109. For example, the adhesive 200 can be disposed on the transducer 109 such that portions of a face of the transducer 109 are not covered by the adhesive 200. Patterning the adhesive 200 can include the removal or controlled deposition of the adhesive 200 in some regions of the transducer 109. The patterning of the adhesive 200 is further described in relation to FIG. 4, among others. The adhesive 200 can be patterned on a face of the transducer 109 using the face using stencil printing, screen printing, laser machining, die cutting, etching, or a combination thereof. In some implementations, the adhesive 200 can be applied or deposited onto a face of the transducer 109 as a uniform sheet (e.g., un-patterned). The uniform sheet can be etched, ablated, machined to remove portions of the adhesive 200 from the face of the transducer 109. In some implementations, the adhesive 200 can be patterned as a film that can be attached to a face of the transducer 109. The transducer 109 can include registration pins or fiducial markers to enable the adhesive 200 to be aligned with the transducer 109. In some implementations, the adhesive 200 can be applied as a uniform sheet of adhesive 200 that is then patterned or as a pre-patterned film which can be applied to the microfluidic flow chamber 108, which can then be coupled with the transducer 109.

The patterning of the adhesive 200 can improve the performance of the acoustic separation device when compared to a uniform sheet of mounting material. As illustrated in FIG. 2, when the adhesive 200 is patterned not all portions of the microfluidic flow chamber 108 are in contact (at least indirectly) with the transducer 109. For example, the wall 204(1) is in indirect contact (via the adhesive 200) with the transducer 109 while the wall 204(2) is not in indirect contact with the transducer 109. Reducing the surface area of the microfluidic flow chamber 108 coupled with the transducer 109 can reduce the acoustic power transferred from the transducer 109 to the microfluidic flow chamber 108 and the performance of the acoustic separation device. Coupling only a portion of the microfluidic flow chamber 108 with the transducer 109 via the patterned adhesive 200 can cause the acoustic separation device to be more efficient at exciting resonant oscillatory modes of the microfluidic flow chamber 108. The patterned adhesive 200 can improve the acoustophoresis of the acoustic separation device without changing the dimensions of the microfluidic flow chamber 108.

Figure 3:
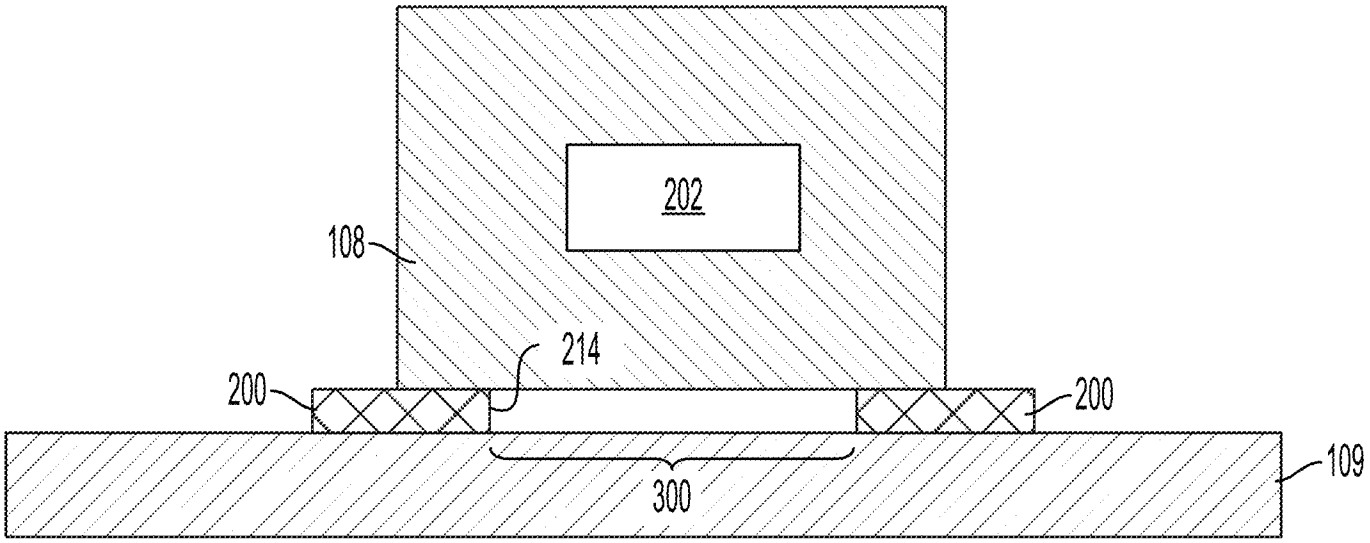

FIG. 3 illustrates an example microfluidic flow chamber 108 coupled with a transducer 109. The adhesive 200 can be patterned to form a gap 300 beneath the microfluidic channel 202. For example, the adhesive 200 can couple with the lateral edges (e.g., the walls 204) of the microfluidic flow chamber 108. As illustrated in FIG. 3, the lateral edges can be coupled with the transducer 109 via the adhesive 200 while the portion of the microfluidic flow chamber 108 beneath the microfluidic channel 202 is not coupled with the transducer 109.

The gap 300 can have a width substantially equal to the width of the microfluidic channel 202. The gap 300 can have a width greater than the width of the microfluidic channel 202. For example, the ends 214 of the adhesive 200 can terminate at a horizontal location within the width of the walls of the microfluidic channel 202 such that a portion of the microfluidic flow chamber 108 beneath the walls is coupled with the adhesive 200 and transducer 109. The edges 214 of the adhesive can terminate at non-symmetric horizontal locations relative to the two walls 204. The gap 300 can have a length substantially equal to the length of the microfluidic channel 202. In some implementations, the microfluidic channel 202 can include a separation region. The separation region can be a region of the microfluidic channel 202 where acoustic waves are applied to the microfluidic channel 202 to drive the particles within fluid flowing through the microfluidic channel 202 to an aggregation axis. The gap 300 can have a length substantially equal to the length of the separation region.

Figure 4:
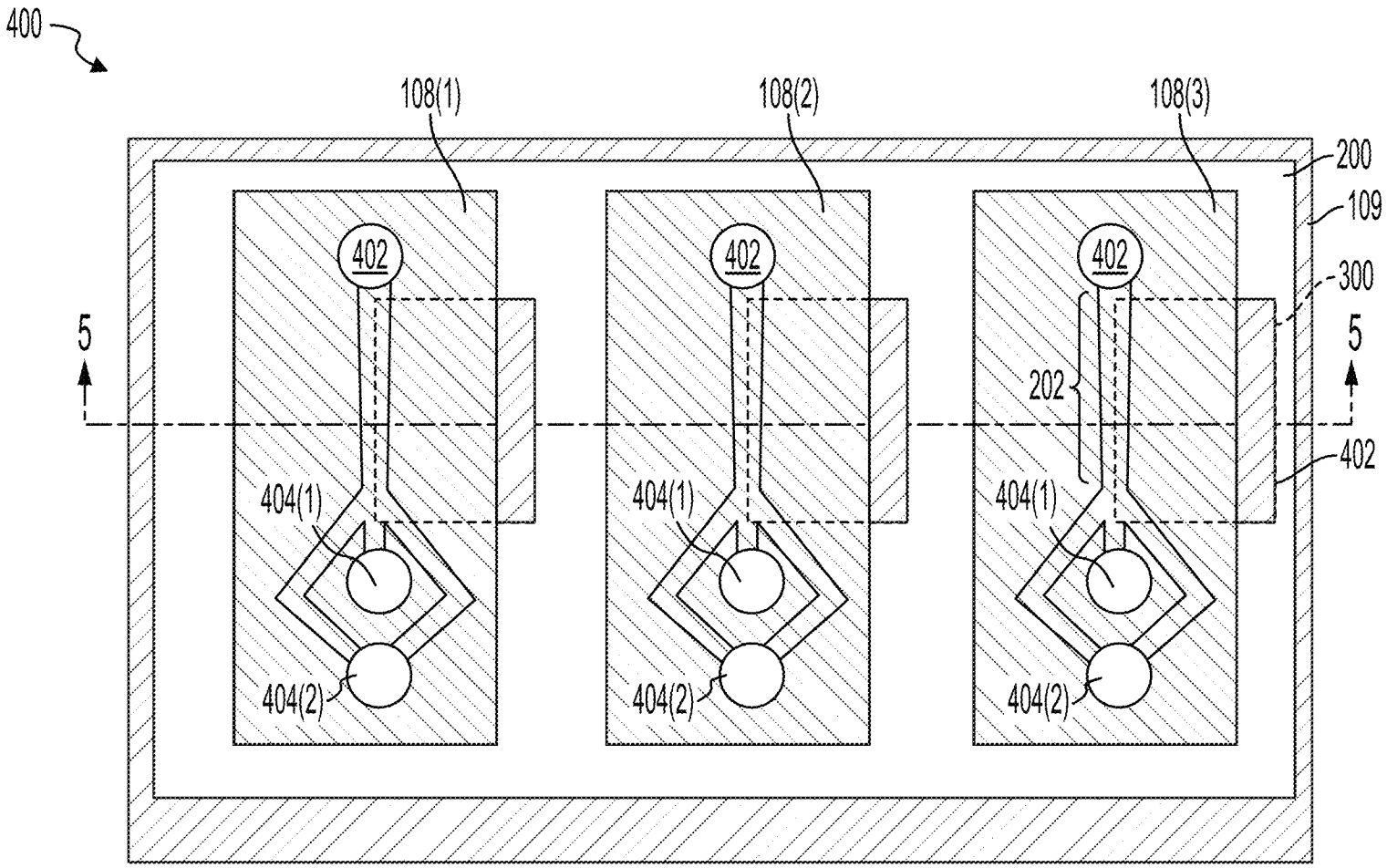
FIG. 4 illustrates a top view of an acoustic separation device that can be used in the system illustrated in FIG. 1.
Figure 5:
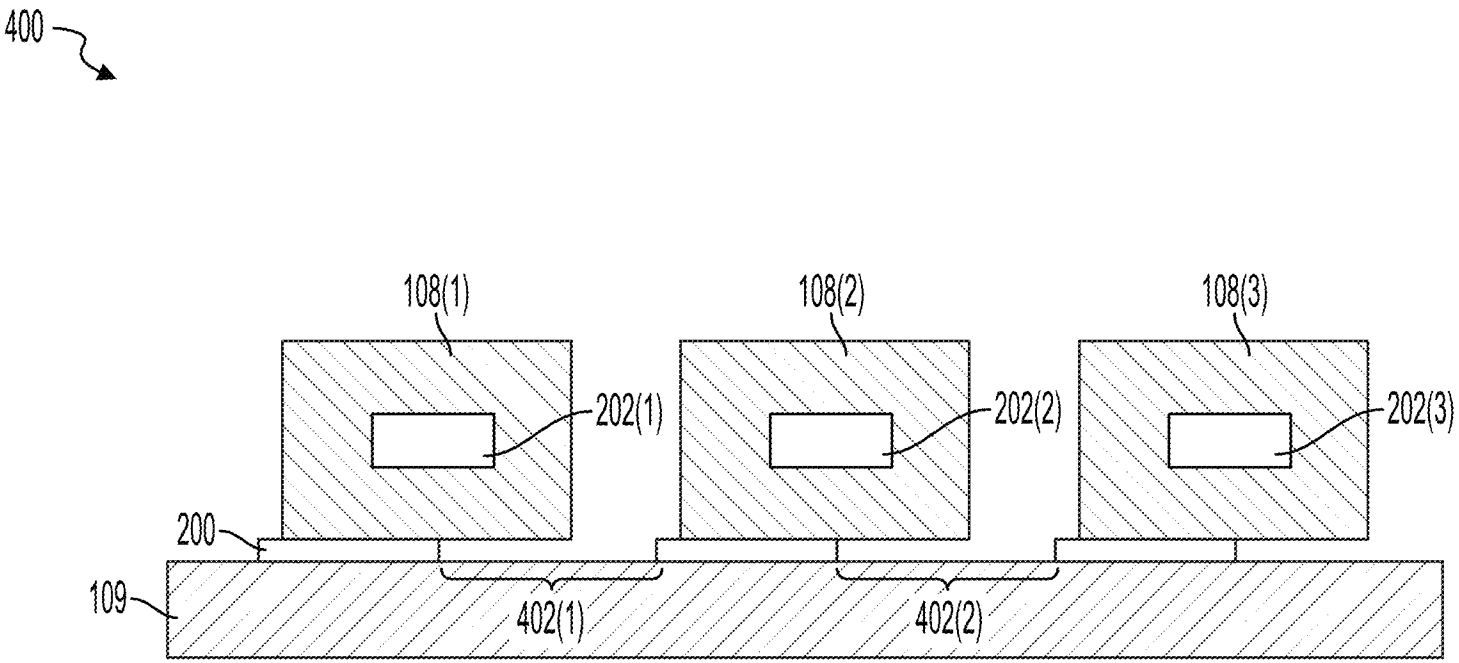
FIG. 5 illustrates a cross-sectional view of the acoustic separation device illustrated in FIG. 4.

FIGS. 4 and 5 illustrate a top view of an acoustic separation device 400 and a cross-sectional view of the acoustic separation device 400, respectively. The acoustic separation device 400 can include a transducer 109. The microfluidic flow chambers 108(1)-108(3), which can generally be referred to as microfluidic flow chambers 108, are coupled to the transducer 109 by the adhesive 200. As illustrated, the acoustic separation device 400 includes three microfluidic flow chambers 108. The acoustic separation device 400 can include between about 1 and about 100, between about 1 and about 80, between about 1 and about 60, between about 1 and about 50, between about 4 and about 50, between about 4 and about 40, between about 4 and about 40, or between about 4 and about 30 microfluidic flow chambers 108. The number of microfluidic flow chambers 108 can be based on the fluidic throughput desired for a particular use. For example, if each microfluidic flow chamber 108 has a fluidic throughput of X μL/min and the use requires a throughout of 10X μL/min, the acoustic separation device 400 can be configured with 10 microfluidic flow chambers 108.

The acoustic separation device 400 can include microfluidic channels 202 within each of the microfluidic flow chambers 108. For example, each of the microfluidic flow chambers 108 can include a single microfluidic channel 202. In some implementations, each microfluidic flow chamber 108 can include a plurality of microfluidic channels 202. For example, the acoustic separation device 400 can include a single microfluidic flow chamber 108 that includes a plurality of microfluidic channels 202. Each microfluidic channel 202 can include an inlet 402. Each microfluidic channel 202 can include a first outlet 404(1) and a second outlet 404(2), which can generally be referred to as outlets 404. One of the outlets 404 can receive waste and can be fluidically coupled with second outlet 112 to deposit the waste in the waste collection unit 113. One of the outlets 404 can receive substantially clean fluid and be fluidically coupled with the first outlet 110 to deposit the cleansed fluid in the collection unit 104. For example, and with reference to FIG. 4, the waste particles can be directed toward a central, longitudinal axis of the microfluidic channel 202 such that the waste particles are driven toward the outlets 404(1). Fluid substantially free of the waste particles can remain towards the walls of the microfluidic channels 202 and can exit the microfluidic channel 202 via the outlet 404(2).

As illustrated in FIGS. 4 and 5, the adhesive 200 can include a repeating pattern such that a gap 300 is formed beneath a portion of each of the microfluidic flow chambers 108. At the gaps 300, the microfluidic flow chambers 108 are not directly coupled with the transducer 109. The gaps 300 can extend along the length of the microfluidic channel 202. In some implementations, the gap 300 can be positioned such that half of the width of the microfluidic channel 202 is coupled with the adhesive 200 and transducer 109 and half of the width of the microfluidic channel 202 is not coupled with the adhesive 200, as illustrated in FIG. 2. In some implementations, the adhesive 200 can be patterned such that only the lateral edges of the microfluidic flow chamber 108 is coupled with the adhesive 200, as illustrated in FIG. 3.

Figure 6:
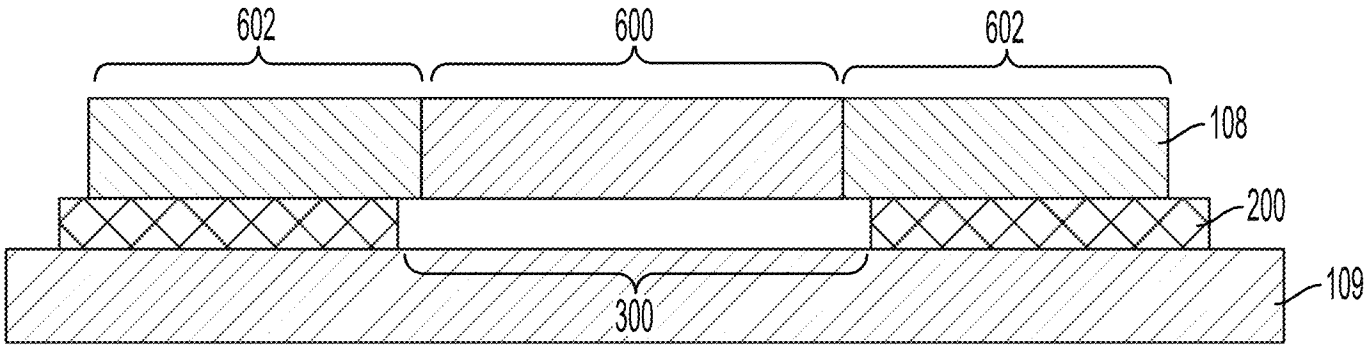
FIGS. 6-9 illustrate cross-sectional views of example acoustic separators that can be used in the system illustrated in FIG. 1.

FIG. 6 illustrates a cross-sectional view of an example acoustic separator. The acoustic separator can include a microfluidic flow chamber 108 that is coupled with a transducer 109 via a patterned adhesive 200. The adhesive 200 is patterned to form a gap 300 in the adhesive 200 beneath at least a portion of the microfluidic flow chamber 108. The portion of the microfluidic flow chamber 108 above the gap 300 can be referred to as an isolation region 600. The isolation region 600 can reduce energy transfer between the portions 602 of the microfluidic flow chamber 108 or between the transducer 109 and the isolation region 600. The isolation region 600 can be thermally isolated from the transducer 109. For example, the air (or gas) within the gap 300 can thermally isolate the isolation region 600 from the transducer 109. The thermal isolation can reduce the amount of heat that the transducer 109 transfers to the isolation region 600.

In some implementations, the transducer 109 can be configured to increase the performance of the acoustic separator. The transducer 109 can be coupled with the microfluidic flow chamber 108 and can excite acoustic modes in physical cavities, such as the microfluidic channels 202. The transducer 109 is electrically stimulated (or driven) at a selected frequency of the transducer 109 to excite a resonant mode in the microfluidic channels 202. The resonant mode can cause one or more nodes or anti-nodes to form in the microfluidic channels 202. The particles, depending on their acoustic contrast, can migrate to the one or more pressure nodes or anti-nodes.

Figure 7:
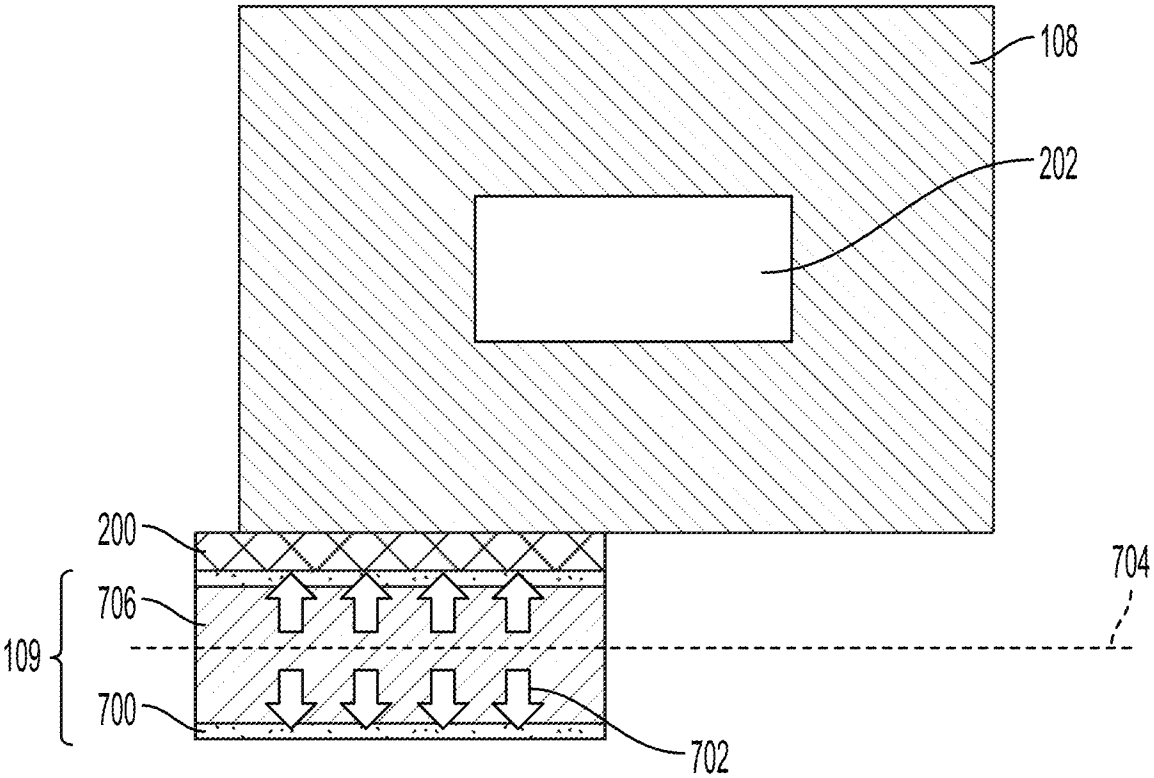

FIG. 7 illustrates a cross-sectional view of an example acoustic separation device. The acoustic separation device can include one or more microfluidic flow chambers 108 that can include one or more microfluidic channels 202. The microfluidic flow chamber 108 can be coupled with a transducer 109 via an adhesive 200. The transducer 109 can include a piezoelectric substrate 706. Electrodes 700 can be coupled to one or more faces of the piezoelectric substrate 706.

The piezoelectric substrate 706 can be a ceramic plate. The piezoelectric substrate 706 can include lead zirconate titanate (PZT), Barium titanate, bismuth sodium titanate, lithium niobate, aluminum nitride. The resonant frequency of the piezoelectric substrate 706 can be based on the material of the piezoelectric substrate 706. The electrodes 700 on the faces of the piezoelectric substrate 706 are driven by a radio frequency electrical signal to cause the piezoelectric substrate 706 to expand and contract. The resonant frequency of the transducer 109 can be based on a thickness, a length, width, material, or any combination thereof the transducer 109.

The electrical signal applied to the electrodes 700 can activate the transducer 109 in different modes. A first mode can be referred to as a "thickness" mode. A second mode, described further in relation to FIG. 9, among others, can be referred to as a "bending" mode. When activated in the thickness mode, both faces of the piezoelectric substrate 706 expand away from each other or contract toward each other in unison. As illustrated in FIG. 7, all of the piezoelectric substrate 706 is expanding in the direction 702. For microfluidic flow chambers 108 containing rigid materials, the transducer 109 dimensions can be selected such that the transducer can be operated in the thickness mode. The high impedance contrast between the rigid channel walls and the fluid within the microfluidic channel 202 can result in few and distinct resonant modes in the cavity. In some implementations, a relatively rigid material (or high impedance contrast material) can have a relatively high acoustic impedance relative to the aqueous fluid in the channel. For example, the rigid material can have an acoustic impedance between about 5 and 15 times higher than the acoustic impedance of the aqueous fluid in the channel. The polymer-based device (or low impedance contract materials can have an acoustic impedance that is between about 1.5 and about 5 times higher than the acoustic impedance of the aqueous fluid in the channel. For example, the polymer-based device can have an acoustic impedance that is about 2 times the acoustic impedance of the aqueous fluid in the channel.

When driven to excite other modes at frequencies different from the thickness mode, portions of the transducer 109 displace in one direction as different portions of the transducer 109 displace in the opposite direction. As described further in relation to FIG. 10B, these different frequencies can be operating the transducer 109 in bending modes. Each of the modes can have a different operational pattern. Each operational pattern can have a characteristic wavelength. For example, the wavelength of the oscillatory motion for each of the modes can be different such that each mode has a different pattern to the regions that move in unison. The transducer 109 can be configured to operate in the bending mode when microfluidic flow chamber 108 includes an elastic material. The transducer 109 can operate at between about 0.1 MHz and about 10 MHz, between about 0.1 MHz and about 8 MHz, between about 0.1 MHz and about 6 MHz, between about 0.2 MHz and about 4 MHz, or between about 0.4 MHz and about 2 MHz.

Figure 8:
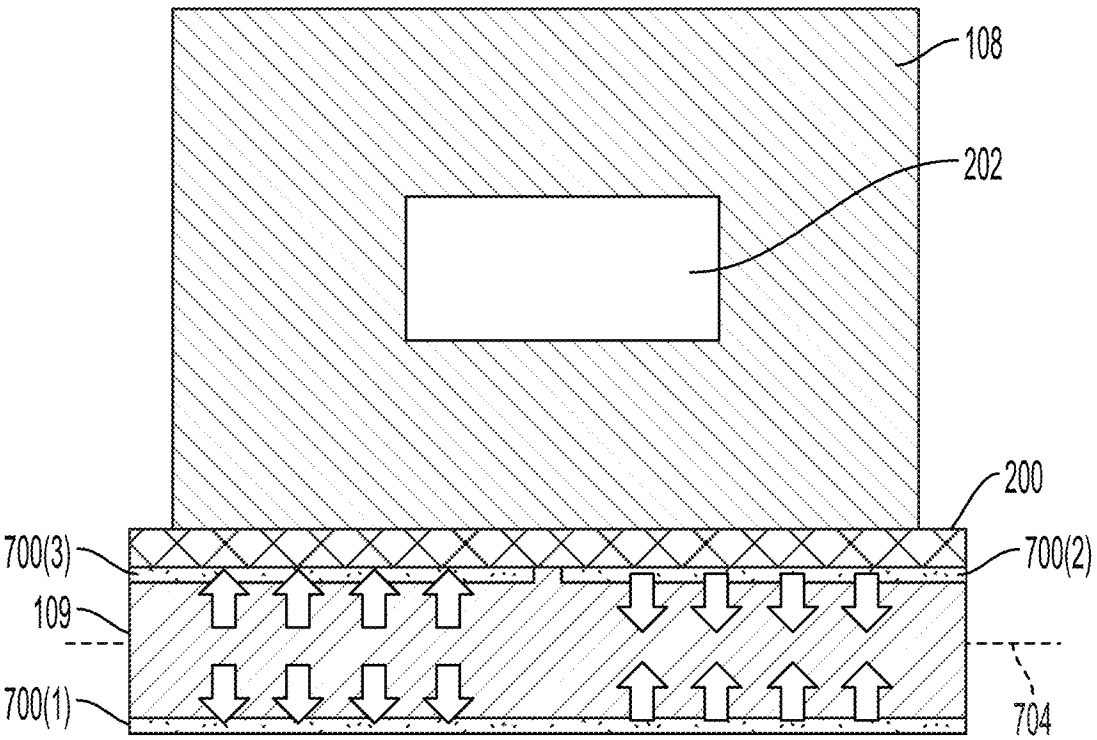

FIG. 8 illustrates a cross-sectional view of an example acoustic separation device. The transducer 109 illustrated in FIG. 8 is operated in the thickness mode. The transducer 109 can include a plurality of electrodes 700. For example, the electrode 700(1) can be a ground electrode. The electrode 700(2) and the electrode 700(3) can be electrodes for driving the transducer 109. The electrode 700(2) and the electrode 700(3) can be driven in phase or out of phase with one another. For example, as illustrated in FIG. 8, the electrode 700(2) and the electrode 700(3) are driven out of phase such that one portion of the transducer 109 is contracting while the second portion of the transducer 109 is expanding.

Figure 9:
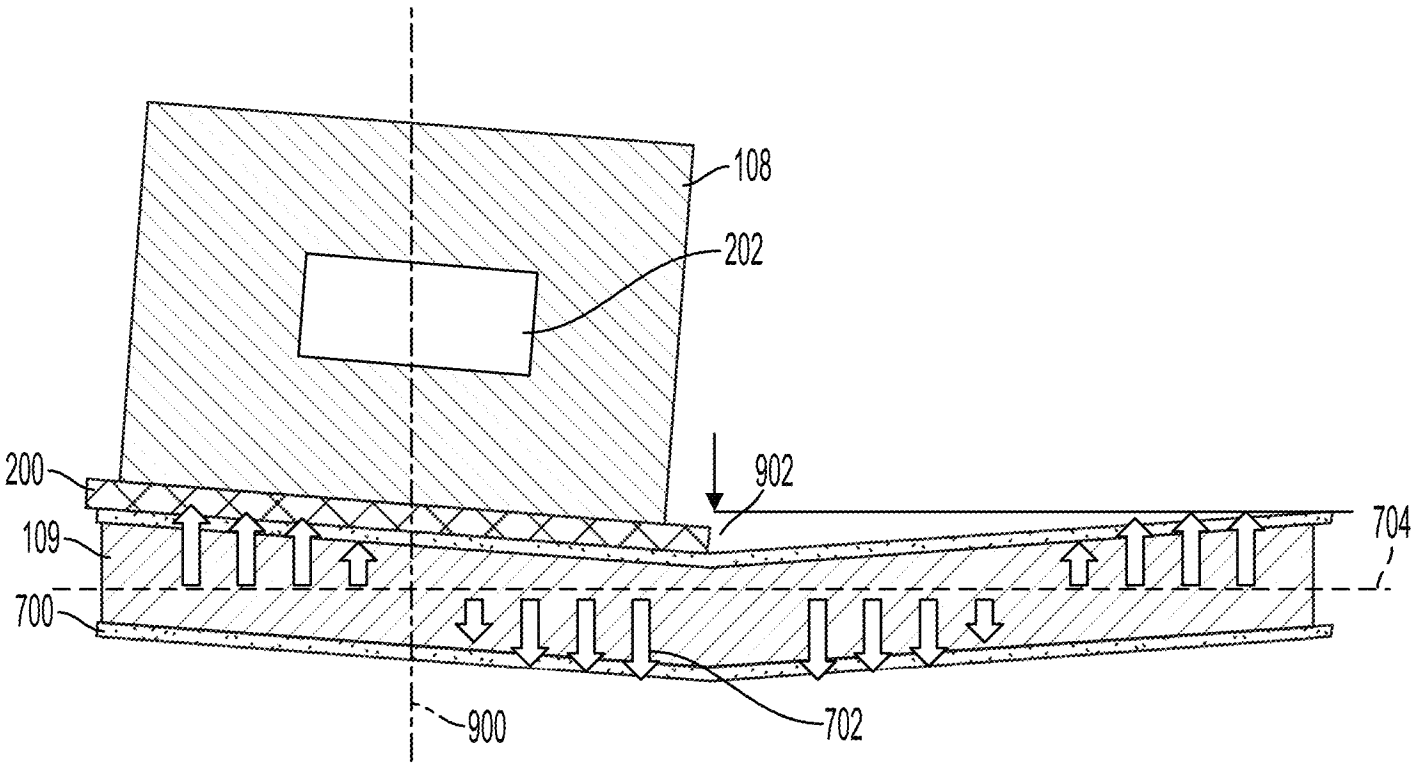

FIG. 9 illustrates a cross-sectional view of an example acoustic separation device. The transducer 109 illustrated in FIG. 9 is operated in the bending mode. As illustrated in FIG. 9, the transducer 109 is operated at a frequency such that the oscillation of the transducer 109 comprises a standing wave along the plane 704. To operate in a bending mode, the frequency of the electrical signal applied to the electrodes 700 can be lower than the frequency of the electrical signal applied to the electrodes 700 during operation in the thickness mode. The electrical signal frequency selected for the thickness mode can be based on the thickness of the transducer 109. The transducer 109 can be substantially planar or flat when not activated.

When operated in a bending mode, the transducer 109 can portions of the transducer 109 can deflect a distance 902. The amplitude of the distance 902 can be between about 1 nm and about 100 nm. In the bending mode, the transducer 109 can be activated at a frequency to form one or more nodes 900 along the plane 704. The nodes 900 can be referred to as displacement nodes 900. The nodes 900 can be locations where the displacement direction 702 of the transducer 109 crosses the plane 704 or otherwise changes direction. At the nodes 900, the transducer 109 can exert little to no displacement when the transducer 109 is active. The microfluidic channel 202 can be aligned with one of the nodes 900. For example, the center of the microfluidic channel 202 (e.g., the microfluidic channel's symmetry axis) can be substantially aligned with the node 900. In some implementations, the node 900 can be aligned with a face of the microfluidic channel's wall or the microfluidic channel's wall.

Figure 10A:
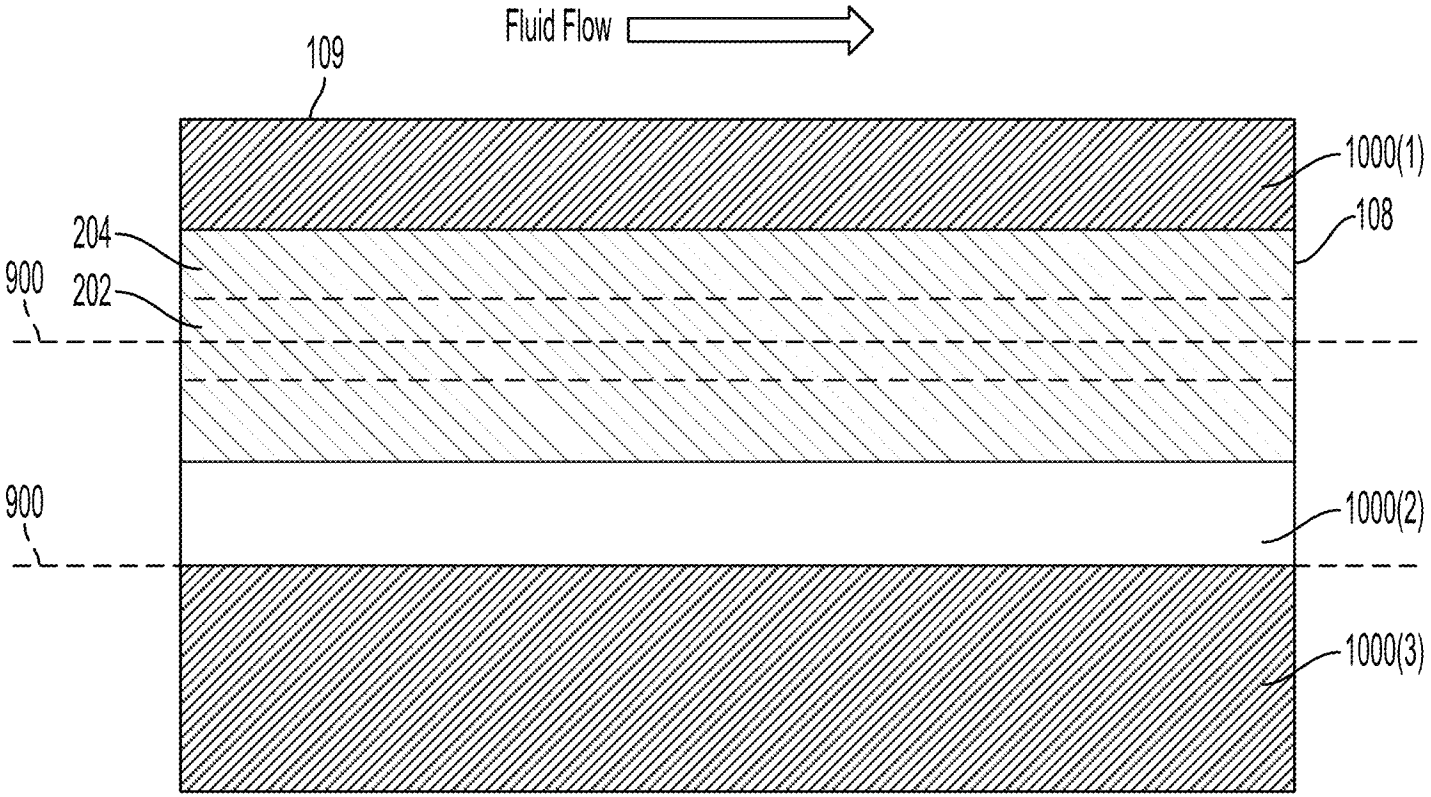
FIG. 10A illustrates a top view of an example acoustic separation device that can be used in the system illustrated in FIG. 1.

FIG. 10A illustrates a top view of a portion of an example acoustic separation device. The acoustic separation device illustrated in FIG. 10A can be similar to the acoustic separation device illustrated in FIG. 9. The acoustic separation device can include a microfluidic flow chamber 108 coupled with a transducer 109. A microfluidic channel 202 can be defined within the microfluidic flow chamber 108. The microfluidic flow chamber 108 can include a wall 204 on either side of the microfluidic channel 202. The transducer 109 is stimulated at a frequency to generate a mode having three regions 1000(1)-1000(3) across the transducer 109. Within a region the transducer 109 can actuate in the same direction. For example, and also with reference to FIG. 9, as the region 1000(1) and the region 1000(3) are displaced upward the region 1000(2) can be displaced downward in one phase of the oscillation and then as the region 1000(2) is displaced upward the region 1000(1) and the region 1000(3) can be displaced downward.

As illustrated in FIG. 10A, the microfluidic flow chamber 108 is positioned on the transducer 109 such that the node 900 aligns with the symmetry axis (e.g., center) of the microfluidic channel 202. In some implementations, the node 900 can align with a face of a wall 204 or one or more of the walls 204.

Figure 10B:
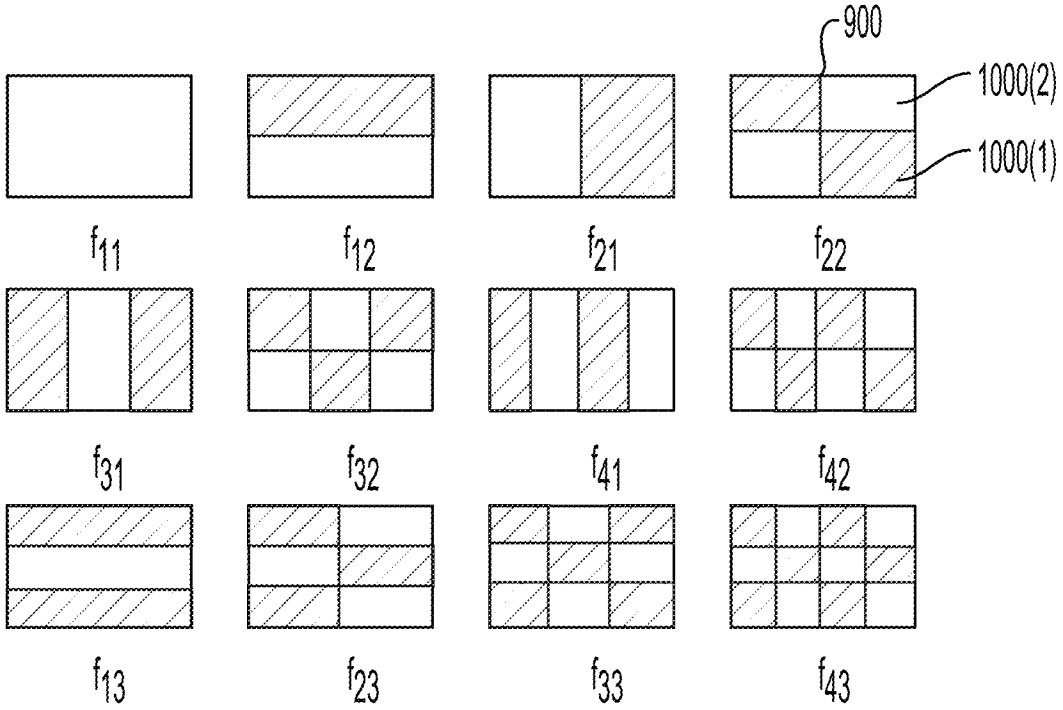
FIG. 10B illustrates different operational modes of an example transducer that can be used in the system illustrated in FIG. 1.

FIG. 10B illustrates a top view different operational modes of an example rectangular plate-shaped transducer 109. The operational mode f11 illustrates the operation of the transducer 109 in the thickness mode or in the lowest order bending mode. When operating in the thickness mode, the transducer 109 includes a single region that oscillates in a substantially uniform manner. For example, substantially all of the transducer 109 actuates normal to surface of the plate in one direction and then substantially all of the transducer 109 actuates in the opposing direction. The operational modes f12-*f*43 illustrate the operation of the transducer 109 in other modes. In the operational modes f12-*f*43, the shaded areas can move out-of-phase relative to the unshaded areas. For example, when one region is moving toward the observer, the other region is moving away from the observer. When operating in the bending mode, the transducer 109 includes a plurality of regions 1000. Neighboring regions 1000 can oscillate in different directions. For example, the region 1000(1) can be moving in a first direction as the region 1000(2) moves in a second direction opposite to the first region. The region 1000(1) and the region 1000(2) interface at a node 900. Each of the different modes can occur at a frequency different from the transducer's thickness mode resonant frequency.

Figure 11:
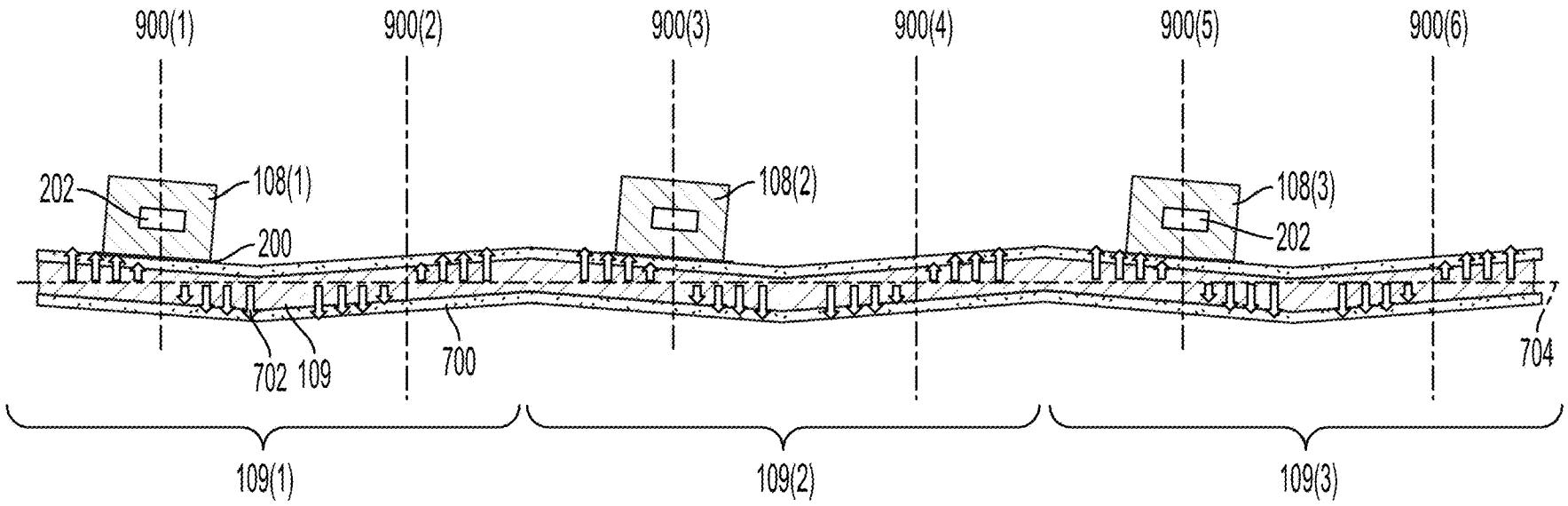
FIG. 11 illustrates a cross-sectional view of an example acoustic separation device that can be used in the system illustrated in FIG. 1.

FIG. 11 illustrates a cross-sectional view of an example acoustic separation device. The acoustic separation device includes microfluidic flow chambers 108(1)-108(3). Each of the microfluidic flow chambers 108 can include one or more microfluidic channels 202. The acoustic separation device can include a plurality of transducers 109(1)-109(3). In some implementations, the transducers 109(1)-109(3) can be separate transducers 109. In some implementations, the transducer 109(1)-109(3) can be different portions or regions of the same transducer 109. In some implementations, the transducer 109 can include grooves in one or more faces of the transducer 109. The grooves can be equally spaced along the width of the transducer 109. For example, the transducer 109 can be a groove between each of the microfluidic flow chambers 108. The grooves can force the transducer 109 to operate at a predetermined operational mode (as illustrated in FIG. 10B) with a desired dimension and frequency.

The acoustic separation device can include between about 1 and about 50, between about 1 and about 40, between about 1 and about 30, between about 1 and about 20, between about 2 and about 20, between about 4 and about 20, or between about 4 and about 10 transducers 109 (or regions of one or more transducers 109). The acoustic separation device can include between about 1 and about 100, between about 1 and about 80, between about 1 and about 60, between about 1 and about 50, between about 4 and about 50, between about 4 and about 40, between about 4 and about 40, or between about 4 and about 30 microfluidic channels 202.

The transducers 109 can generate a plurality of nodes 900(1)-900(6). The microfluidic channels 202 can be aligned with every other node 900 such that each of the microfluidic channels 202 experience the same movement at the same time (e.g., the microfluidic channels 202 move in phase with one another). In some implementations, the microfluidic channels 202 can be aligned on neighboring nodes 900 such that the neighboring microfluidic channels 202 are out of phase with one another.

Figure 12:
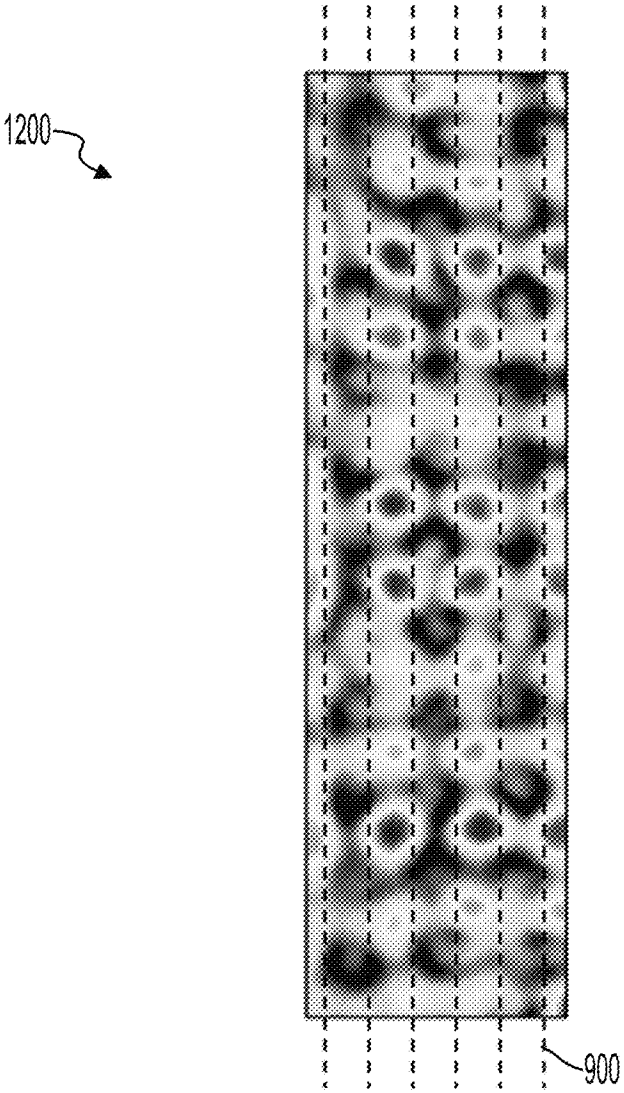
FIGS. 12 and 13 illustrate heat maps of the displacement of an example transducer when activated in various resonant modes.

FIG. 12 illustrates a heat map 1200 of the displacement of a transducer 109 when stimulated with an electrical signal. The heat map 1200 was generated by finite element simulation of a PZT transducer similar to the transducers 109 described herein. The transducer 109 was activated with an electrical signal operating at 0.65 MHz. The red regions indicate regions of the transducer 109 that experienced large displacement in a direction normal to the surface of the transducer 109, in one phase of the oscillation (e.g., a displacement of about 10 nm in a first direction). The dark blue regions indicate regions of the transducer 109 that experienced large displacement in the opposing direction (e.g., a displacement of about 10 nm in a second direction). The green regions experienced relatively low displacement when activated. As illustrated in FIG. 12, the activation of the transducer 109 generates six linear nodes 900 a substantially along the length of the transducer 109. With reference to FIG. 10A, the symmetric axis of a microfluidic channel 202 can be aligned with one of the nodes 900.

Figure 13:
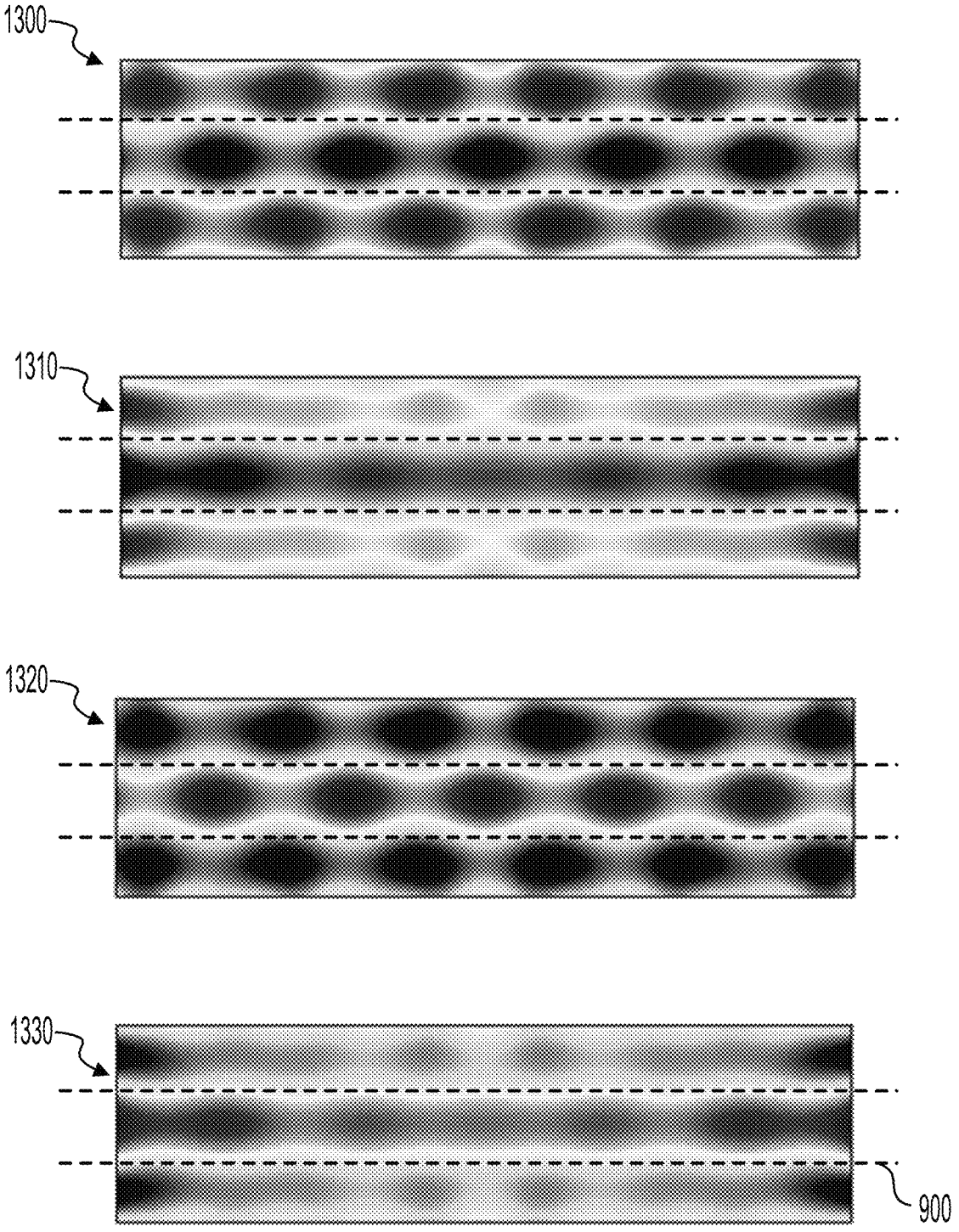

FIG. 13 illustrates heat maps 1300, 1310, 1320, and 1330 of the displacement of a transducer 109 at different phases of the displacement of the transducer 109. The transducer 109 can be operated in a bending mode such that two nodes 900 are formed. The nodes 900 are illustrated as lines that indicate an average experience minimum displacement throughout the oscillations of the transducer 109. In some implementations the nodes 900 may not operate along a straight line as illustrated in FIG. 13. As described above, when operated in the bending mode, the transducer 109 displaces as oscillatory waves extend along a lateral axis of the transducer 109. The oscillatory wave can generate a periodic displacement of the transducer 109. The heat maps 1300-1330 were generated by finite element analysis of an example transducer 109 activated with a 0.426 MHz electrical signal. The transducer 109 was similar to the transducers 109 described herein. The heat map 1300 illustrates the displacement of the transducer 109 at 0 degrees of the oscillatory waveform. The heat map 1310 illustrates the displacement of the transducer 109 at 90 degrees of the oscillatory waveform. The heat map 1320 illustrates the displacement of the transducer 109 at 180 degrees of the oscillatory waveform. The heat map 1330 illustrates the displacement of the transducer 109 at 270 degrees of the oscillatory waveform. The red regions indicate regions of the transducer 109 that experienced large displacement in a direction normal to the surface of the transducer 109, in one phase of the oscillation. The dark blue regions indicate regions of the transducer 109 that experienced large displacement in the opposing direction. The green regions experienced relatively low displacement when activated.

Figure 14A:
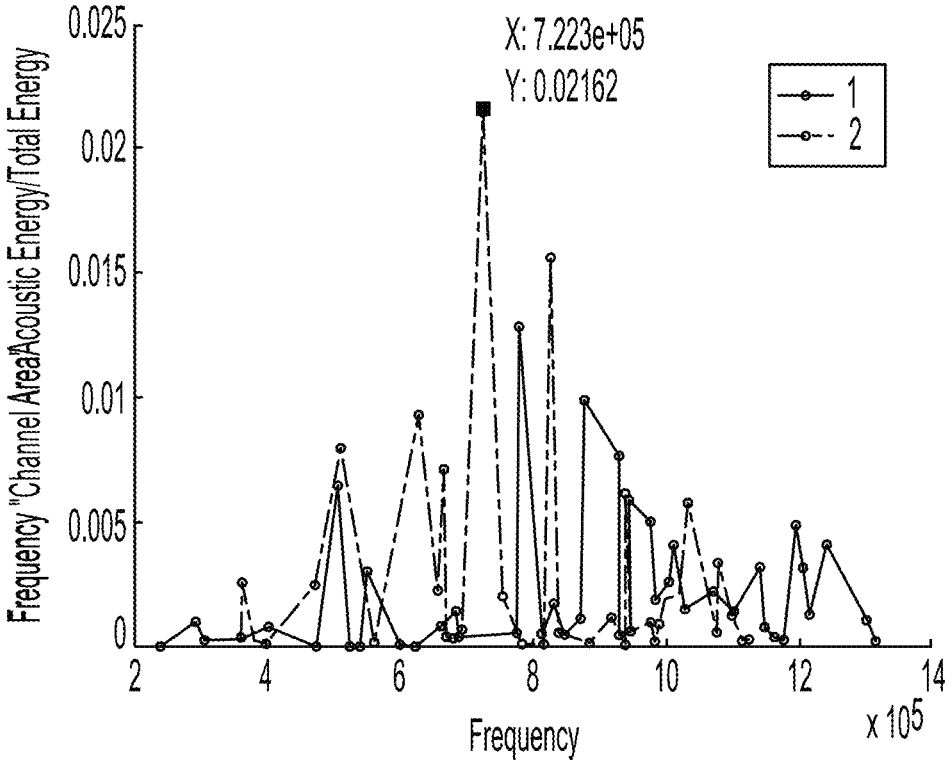
FIG. 14A illustrates a plot of the energy transferred into the fluid of a microfluidic channel through acoustic stimulation as a function of frequency.
Figure 14B:
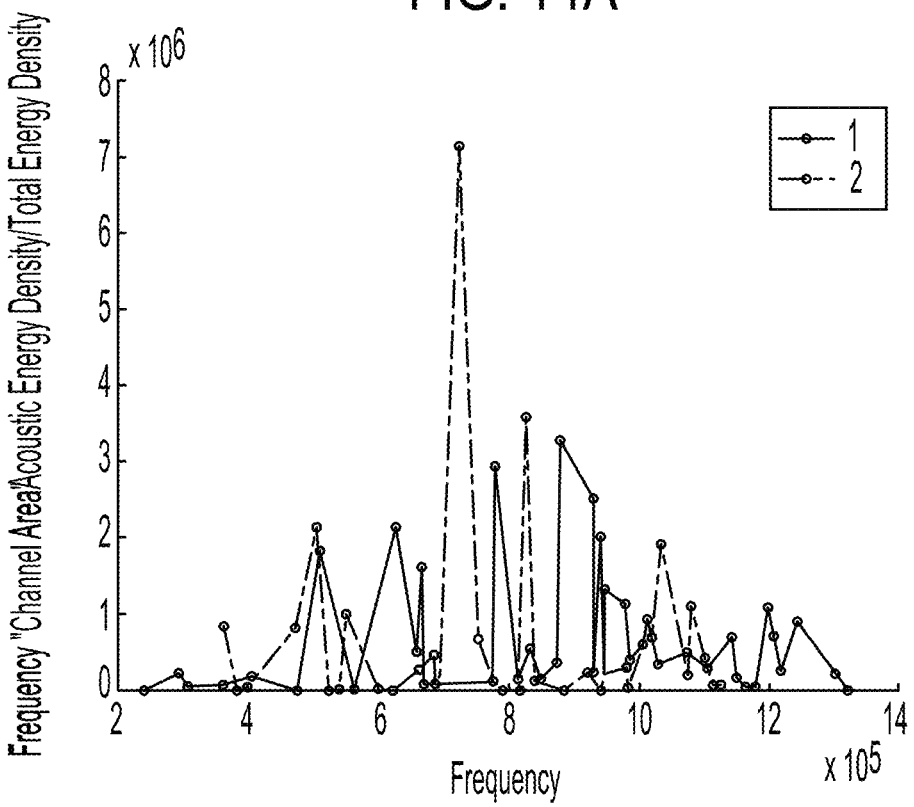
FIG. 14B illustrates a plot of the energy density within the microfluidic channel as a function of frequency.

FIG. 14A illustrates a plot of the energy transferred into the fluid of a microfluidic channel through acoustic stimulation as a function of frequency, according to a finite element simulation. FIG. 14B illustrates a plot of the energy density within the microfluidic channel as a function of frequency. In both plots, line 1 (as indicated by the solid lines) represents the response for a device similar to the microfluidic channel 202 illustrated in FIG. 9 with 2.25 mm wide walls formed from polystyrene. The device associated with line 1 can be referred to as device 1. In both plots, line 2 (as indicated by the dashed lines) represents the response for a device similar to the microfluidic channel 202 illustrated in FIG. 9 with 3.25 mm wide walls formed from polystyrene. The device associated with line 2 can be referred to as device 2. In operation the device, can be stimulated with acoustic waves at a frequency that maximizes the energy or energy density within the microfluidic channel. As illustrated in FIGS. 14A and 14B, greater energy is transmitted into device 2. For example, a greater total energy and energy density is seen in device 2 when the device is acoustically stimulated at about 722 kHz. In this example, a transducer can be selected such that a mode exists also at 722 kHz with a node extending along the transducer's length. A microfluidic channel can be coupled to the transducer with its symmetry axis aligned to the transducer node.

Figure 15A:
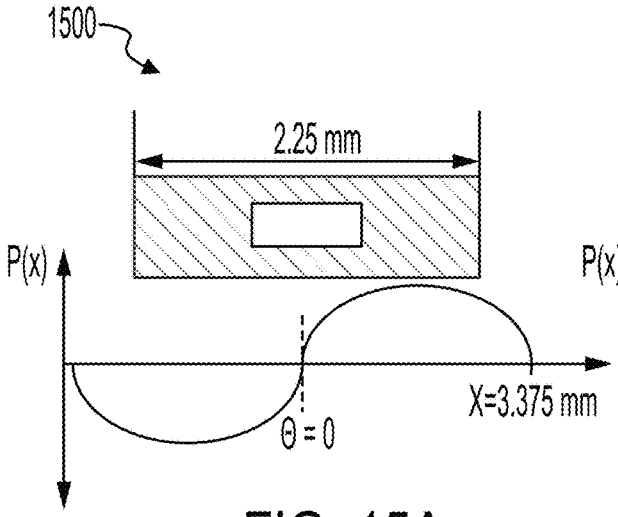
FIGS. 15A-15C illustrate plots of the relationship between acoustophoretic force and channel alignment.
Figure 15B:
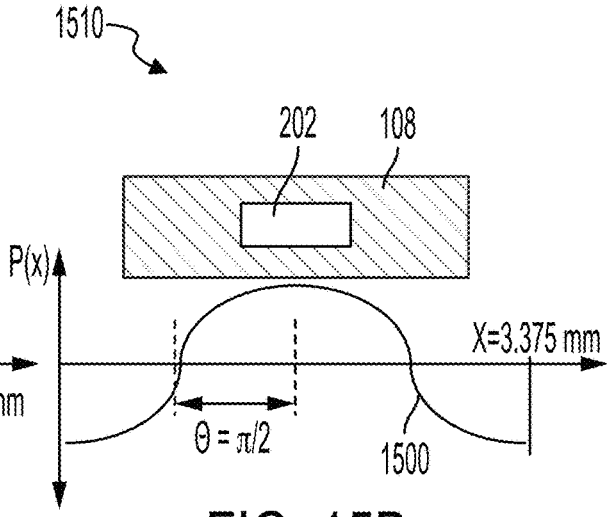
Figure 15C:
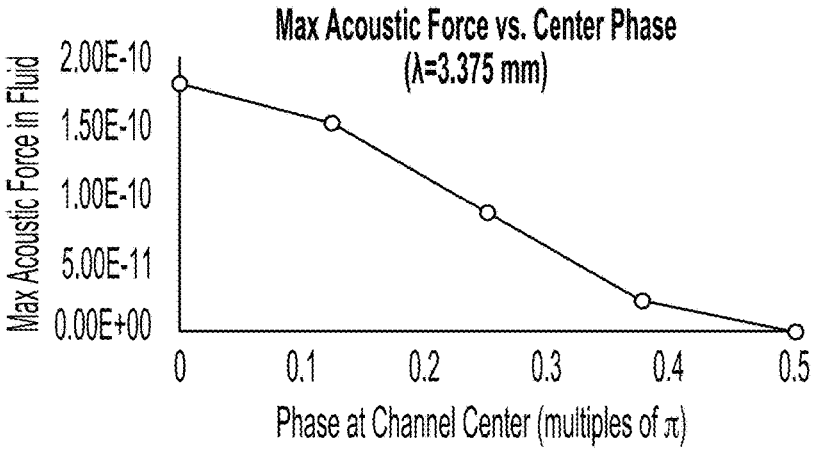

FIGS. 15A-15C illustrate plots of the relationship between acoustophoretic force (in arbitrary units) and channel alignment. The plot 1500 illustrates application of a sinusoidal pressure load (P(x)) to the bottom face of the microfluidic flow chamber 108 where the phase θ=0 is aligned with the symmetry axis of the microfluidic channel 202. The configuration is similar to that illustrated in FIG. 9, where the symmetry axis of the microfluidic channel 202 is aligned with the node 900. The sinusoidal pressure load approximately simulates the pressure a transducer could apply to a microfluidic flow chamber. The node 900 can occur where P(x)=0. The plot 1510 illustrates application of a sinusoidal pressure load (P(x)) to the bottom face of the microfluidic flow chamber 108 where the phase θ=π/2 is aligned with the symmetry axis of the microfluidic channel 202. Referring again to FIG. 9, the configuration illustrated in plot 1510 would place the node 900 within the wall of the microfluidic channel 202. Each of the applied waves in the plot 1500 and 1510 can have a fixed wavelength of 3.375 mm and a frequency of 590 kHz. As illustrated in FIG. 15C, the greatest acoustophoretic force occurs when phase θ=0 of the oscillatory wave is aligned with the symmetry axis of the microfluidic channel 202 as illustrated in FIG. 15A (and FIG. 9). The acoustophoretic force diminishes as the phase is increased to θ=π/2.

Figure 16:
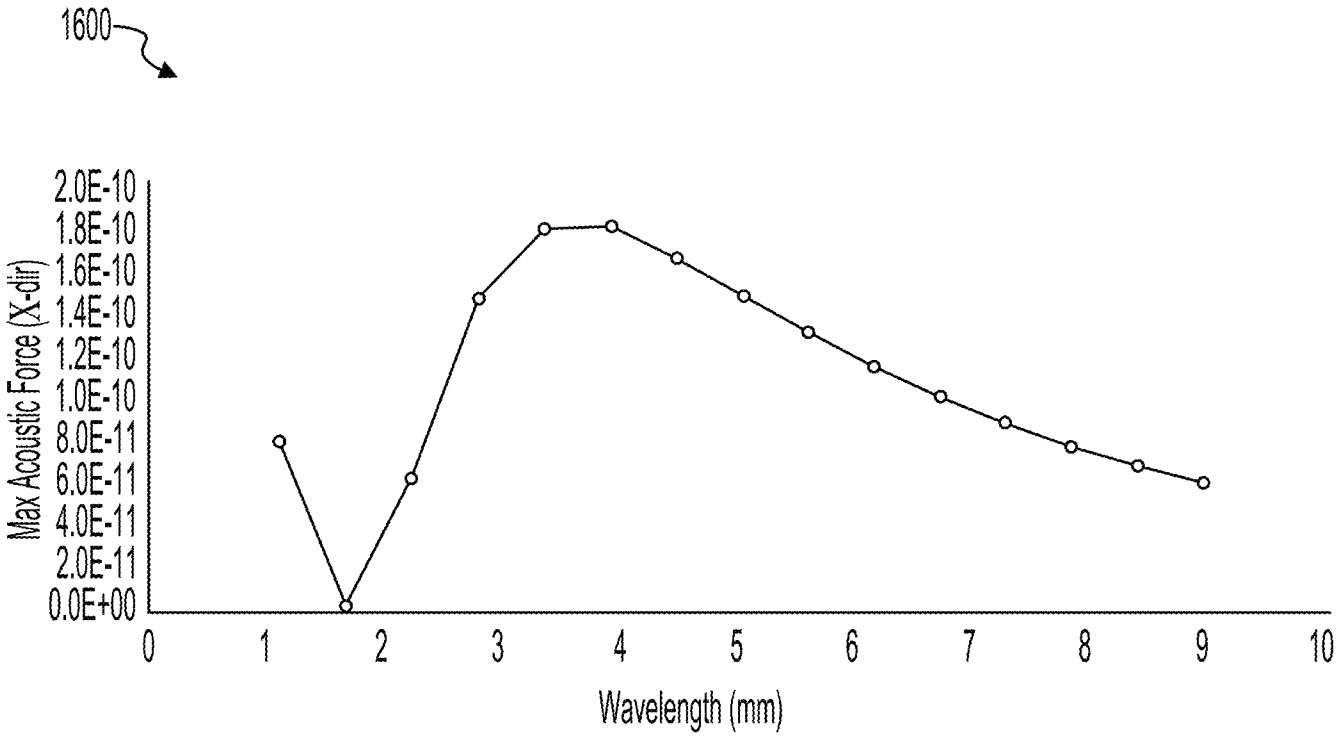
FIG. 16 illustrates a plot of the relationship between acoustophoretic force in the fluid of a microfluidic channel and the wavelength of the applied acoustic waves.

FIG. 16 illustrates a plot 1600 of the relationship between the maximum acoustophoretic force in the fluid of a microfluidic channel and the wavelength of the applied sinusoidal pressure load, according to a finite element simulation. The plot 1500 was generated by stimulating a 2.25 mm wide microfluidic flow chamber at 590 kHz. The channel of the microfluidic flow chamber was 0.55 mm. Each of channel's the two sidewalls were 0.85 mm wide. The "floor" of the channel was 1 mm thick. The channel had a height of 0.250 mm. The "ceiling" of the channel was 0.75 mm thick. As in FIG. 15A, the symmetry axis of the microchannel is aligned with phase θ=0. The microfluidic flow chamber was constructed from polystyrene. As illustrated in FIG. 16, the maximum force occurs when the wavelength is about 3.4 mm, which is about 1.5× the width of the device. In this example, in a preferred embodiment, a transducer could be selected such that a mode exists in the transducer also at 590 kHz with a node extending along the transducer's length. Furthermore, the transducer could be selected such that the wavelength of this mode in the transducer is about 3.4 mm in the direction perpendicular to this node. The microfluidic channel could be coupled to the transducer with its symmetry axis aligned to the transducer node.

Figure 17:
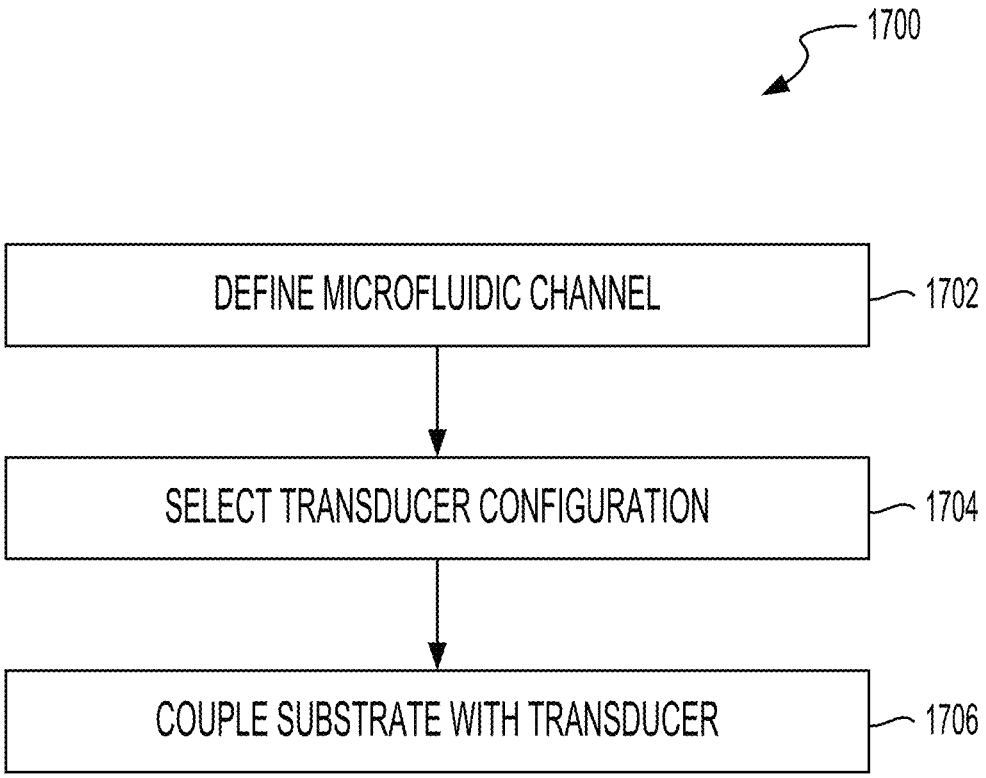
FIG. 17 illustrates a block diagram of an example method for manufacturing an acoustic separation device for use in the system illustrated in FIG. 1

FIG. 17 illustrates a block diagram of an example method 1700 to manufacture an acoustic separation device. The method 1700 can include defining a microfluidic channel (BLOCK 1702). The method 1700 can include selecting a transducer configuration (BLOCK 1704). The method 1700 can include coupling a polymer substrate with the transducer (BLOCK 1706).

As set forth above, the method 1700 can include defining a microfluidic channel (BLOCK 1702). In some implementations, the microfluidic channel can be defined within a substrate. The substrate can be formed from an elastic material, such as a polymer material. For example, the substrate can include a material having softer or more elastic properties than traditionally rigid materials, such as glass. Defining the microfluidic channel can include determining the width, length, and height of the microfluidic channel. In some implementations, defining the microfluidic channel can also include determining a wall thickness. Also referring to FIG. 2, among others, determining a wall thickness can include determining the thickness of each of the walls 204, ceiling 206, or floor 208 (each of which can be referred to as walls). In some implementations, each of the walls can have the same thickness. In some implementations, one or more walls can have different thickness. For example, the ceiling 206 can have a first thickness and the floor 208 can have a second thickness greater than the first thickness. Thus, the substrate in which the microfluidic channel is defined can have a first set of dimensions, including at least a wall thickness, and this first set of dimensions can be selected prior to defining the microfluidic channel in the substrate according to the dimensions.

In some implementations, defining the microfluidic channel can include machining, etching, or otherwise defining the microfluidic within one or more polymer substrates. For example, the microfluidic can be defined as a trough within a first polymer substrate and a second polymer substrate can be coupled with the first polymer substrate to form the ceiling 206 of the microfluidic channel. The polymer substrates can include a plastic, thermoplastic, or lossy plastic. The polymer substrates can include polystyrene, acrylic (polymethylmethacrylate), polysulfone, polycarbonate, polyethylene, polypropylene, cyclic olefin copolymer, silicone, liquid crystal polymer, polyimide, polyetherimide, polyvinylidene fluoride, or a combination thereof. The polymer substrate can be the above described microfluidic flow chamber 108.

In some implementations, the method 1700 can include estimating an excitation frequency of the microfluidic flow chamber. An excitation frequency can be estimated by using a finite element simulation as described in relation to FIG. 14. An excitation frequency can be determined experimentally by flowing a solution of suspended particles through the channel and observing the acoustophoretic displacement of the particles as frequency is varied in a transducer. In some implementations, the microfluidic channel or flow chamber defined in the substrate can be configured to be excited in predetermined oscillatory mode, which in some implementations, may be a rocking mode.

The method 1700 can include selecting a transducer configuration (BLOCK 1704). Selecting the transducer configuration can include determining a thickness, length, width, or stimulation frequency of the transducer. The thickness, length, width, or stimulation frequency of the transducer can be based on the frequency of a resonant mode of the microfluidic channel, which can be dependent on the dimensions of the walls of the microfluidic channel, or dimensions of the microfluidic flow chamber. As described above, the substrate can be excited in a rocking mode by the transducer. In some implementations, the thickness and width of the transducer can be based on the thickness of the microfluidic channel's walls. In some implementations, the dimensions of the transducer can be selected such that the transducer resonates at or near the excitation frequency of the microfluidic flow chamber. For example, in one example, the transducer width can be between about 2 and about 3 times the total width of the microfluidic flow chamber (e.g., the width of the walls plus the width channel).

In some implementations, the transducer can be configured to operate at a predetermined frequency that is different from its primary thickness resonant frequency. For example, the transducer can be configured to operate in a bending mode or other mode different from a thickness mode. In some implementations, this can be achieved by operating the transducer in a lower frequency mode than its primary thickness resonant frequency. For example, this can contrast with traditional devices in which bending mode shapes for a transducer could be considered undesirable, with the lowest order mode preferred instead. The transducer can be configured such that this predetermined frequency also corresponds to that of a preferred resonant mode of the microchannel defined in the substrate.

In some implementations, the transducer configuration and the microchannel configuration can be designed in an interdependent process. For example, an iterative process can be used to select channel dimensions, wall dimensions, and excitation frequency. In some implementations, such parameters can be tested experimentally by acoustophoresis of particles or can be tested in simulation. Likewise, transducer dimensions and resulting mode shapes and frequencies can also be tested experimentally or by simulation. Device dimensions and transducer dimensions can be adjusted and tested iteratively until a desired frequency is identical for both. In some implementations, the devices (e.g., the transducer and the substrate defining the microfluidic channel) can be simulated coupled and appropriately positioned relative to each other, and dimensions may be further adjusted to account for interactions between the two. The interactions may alter the results found for channel and transducer designed separately, and therefore a more desirable design may take into account the coupled interactions.

Thus, in some implementations the transducer dimensions and operating frequency can be chosen in concert with the channel dimensions such that the transducer exerts an asymmetric, or "odd", force on the adjacent channel wall. As a result, the channel can be excited in a rocking mode. This may be achieved, for example, by aligning the symmetry axis of the microchannel with a node in the transducer plate. In some implementations, the transducer can be operated at frequency different from its primary thickness resonance, in contrast with traditional devices.

The method 1700 can include coupling the substrate with the transducer (BLOCK 1706). Also referring to FIGS. 2 and 3, among others, the substrate can form the microfluidic flow chamber 108. The microfluidic flow chamber 108 can be coupled to the transducer 109 with the adhesive 200. For example, the adhesive 200 can be applied to a surface of the transducer 109. The microfluidic flow chamber 108 can be deposited onto the adhesive 200. The microfluidic flow chamber 108 can be clamped to the transducer 109 as the adhesive 200 sets or is cured. In some implementations, after the use of the acoustic separation device, the adhesive 200 can be dissolved with a solvent or heated to enable the microfluidic flow chamber 108 to be decoupled from the transducer 109. In some implementations, the transducer 109 and the microfluidic flow chamber 108 can include alignment pins, alignment markings, or fiducial markers that enable alignment of the microfluidic channel 202 within the microfluidic flow chamber 108 with a displacement node of the transducer 109. For example, the method 1700 can include determining whether the microfluidic channel's symmetry axis should be aligned with the displacement node. The transducer 109 can include alignment pins that mate with holes in the microfluidic flow chamber 108. Mating of the pins can, in this example, align the microfluidic channel's symmetry axis with a displacement node of the transducer 109.

In some implementations, the method 1700 can include aligning a symmetry axis of the microfluidic channel with a displacement node of the transducer. The method 1700 also can include activating the transducer in a bending mode. In some implementations, the method can include applying an electrical signal to the transducer at the predetermined frequency to form an displacement node at a first location along an axis parallel to the surface of the transducer.

In some implementations, prior to coupling the substrate with the transducer in BLOCK 1706, the method 1700 can include defining a gap in an adhesive layer. For example, the gap can be aligned with a portion of the microfluidic channel. In some implementations, the gap can be achieved by patterning at least a portion of the adhesive that joins the transducer with the substrate. Thus, the adhesive 200 can be patterned such that only a portion of the microfluidic flow chamber 108 is coupled with the transducer 109. In some implementations, the adhesive 200 can be applied to one or both of the microfluidic flow chamber 108 and transducer 109 and then patterned. The adhesive 200 can be patterned using stencil printing, screen printing, laser machining, die cutting, etching, or a combination thereof. In some implementations, the adhesive 200 can be a film adhesive that is patterned prior to being deposited on the microfluidic flow chamber 108 or transducer 109. The microfluidic flow chamber 108 or the transducer 109 can include alignment guides (e.g., fiducial markers or alignment pins) that enable the patterned film to be positioned correctly on the surface of the microfluidic flow chamber 108 or the transducer 109. The adhesive 200 can include at least one of a sugar, pectin, gelatin, agar, a hydrogel, glycerol, a wax, or polyethylene glycol. In some implementations the adhesive can be patterned when the transducer 109 is operated in a thickness mode. In some implementations, when the transducer 109 is operated in a bending mode, the adhesive is not patterned.

Figure 18:
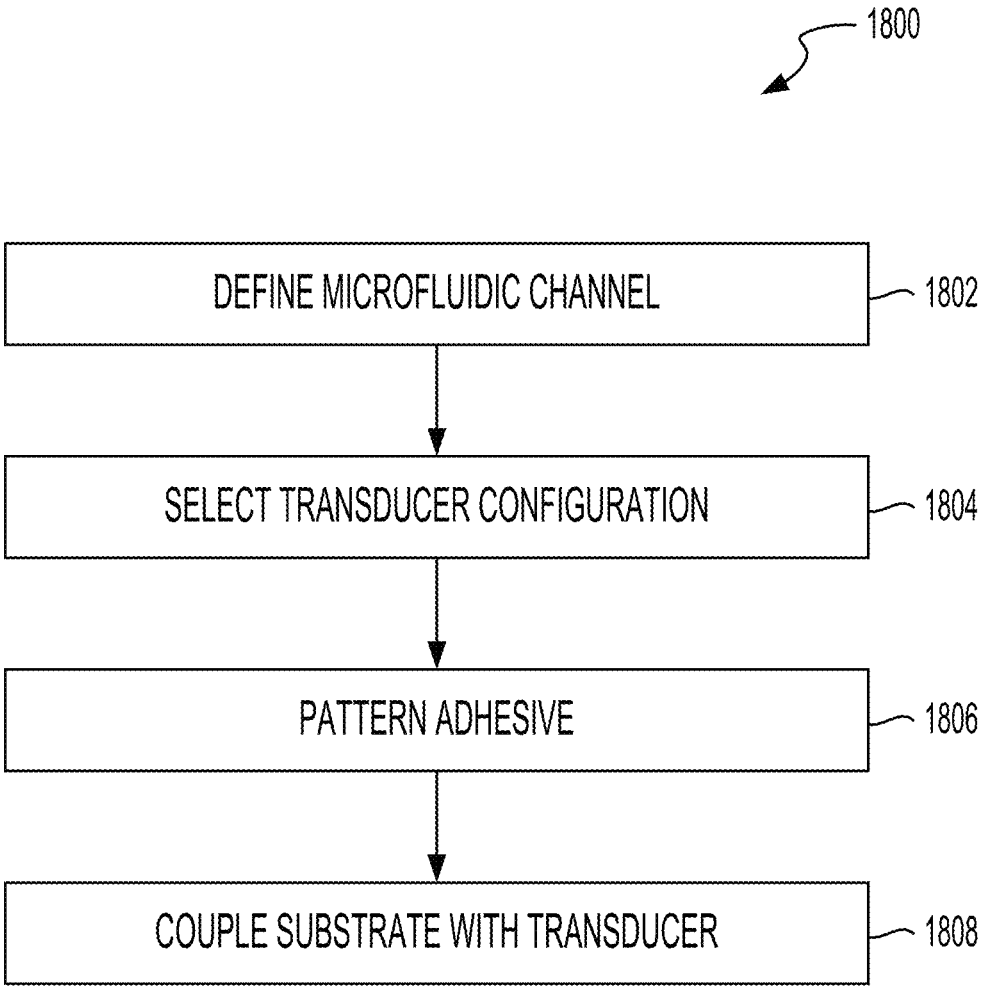
FIG. 18 illustrates a block diagram of an example method for manufacturing an acoustic separation device for use in the system illustrated in FIG. 1.

FIG. 18 illustrates a block diagram of an example method 1800 to manufacture an acoustic separation device. The method 1800 can include defining a microfluidic channel (BLOCK 1802). The method 1800 can include selecting a transducer configuration (BLOCK 1804). The method 1800 can include patterning an adhesive (BLOCK 1806). The method 1800 can include coupling a polymer substrate with the transducer (BLOCK 1808).

As set forth above, the method 1800 can include defining a microfluidic channel (BLOCK 1802). The microfluidic flow channel can be defined within a substrate. For example, the substrate can be formed from an elastic material, such as a polymer material. Defining the microfluidic channel can include determining a width, length, and height of the microfluidic channel. Defining the microfluidic channel can also include determining a wall thickness. Also referring to FIG. 2, among others, determining a wall thickness can include determining the thickness of each of the walls 204, ceiling 206, or floor 208 (each of which can be referred to as walls). In some implementations, each of the walls can have the same thickness. In some implementations, one or more walls can have different thickness. For example, the ceiling 206 can have a first thickness and the floor 208 can have a second thickness greater than the first thickness.

In some implementations, defining the microfluidic channel can include machining, etching, or otherwise defining the microfluidic within one or more polymer substrates. For example, the microfluidic channel can be defined as a trough or groove within a first polymer substrate, and a second polymer substrate can be coupled with the first polymer substrate to form the ceiling 206 of the microfluidic channel. The polymer substrates can be formed from a plastic, thermoplastic, or lossy plastic. The polymer substrates can include polystyrene, acrylic (polymethylmethacrylate), polysulfone, polycarbonate, polyethylene, polypropylene, cyclic olefin copolymer, silicone, liquid crystal polymer, polyimide, polyetherimide, polyvinylidene fluoride, or a combination thereof. In some implementations, the polymer substrate can be the above described microfluidic flow chamber 108.

In some implementations, the method 1800 can include estimating an excitation frequency of the microfluidic flow chamber. An excitation frequency can be estimated by using a finite element simulation, for example as described in relation to FIG. 14. An excitation frequency can be determined experimentally by flowing a solution of suspended particles through the channel and observing the acoustophoretic displacement of the particles as frequency is varied in a transducer.

The method 1800 can include selecting a transducer configuration (BLOCK 1804). Selecting the transducer configuration can include determining a thickness, length, width, or stimulation frequency of the transducer. The thickness, length, width, or stimulation frequency of the transducer can be based on the frequency of a resonant mode of the microfluidic channel, which can be dependent on the dimensions of the walls of the microfluidic channel, or dimensions of the microfluidic flow chamber. For example, the thickness and width of the transducer can be based on the thickness of the microfluidic channel's walls. The dimensions of the transducer can be selected such that the transducer resonates at or near the excitation frequency of the microfluidic flow chamber. For example, in one example, the transducer width can be between about 2 and about 3 times the total width of the microfluidic flow chamber (e.g., the width of the walls plus the width channel). The transducer can be configured or selected to impart an acoustic wave onto a fluid in the microfluidic channel.

The method 1800 can include patterning an adhesive (BLOCK 1806). Also referring to FIGS. 2 and 3, among others, the microfluidic flow chamber 108 can be mechanically coupled with the transducer 109 by an adhesive 200. The adhesive 200 can be patterned such that only a portion of the microfluidic flow chamber 108 is coupled with the transducer 109. For example, the adhesive layer can be patterned to form a coupling region that mechanically couples the transducer with the substrate defining the microfluidic channel, while an uncoupled region can exist in which a gap is positioned between the transducer and the substrate due to the pattern of the adhesive material.

In some implementations, the patterning shape of the adhesive layer can be selected based on a resonant mode of the substrate in which the microfluidic channel is defined. For example, the adhesive layer can be patterned such that transducer stimulates that substrate at the desired resonant mode when the transducer is coupled with the substrate via the patterned adhesive layer. In some implementations, the adhesive layer can be patterned such that the coupling region is aligned along a first side of a central axis of the microfluidic channel defined by the substrate, while the uncoupled region is aligned along a second side of the central axis of the microfluidic channel defined by the substrate, opposite the first side of the central axis. In some other implementations, the coupling region can include two or more discontinuous areas. For example, the coupling region can include a first coupling region aligned along a first side of a central axis of the microfluidic channel defined by the substrate and a second coupling region aligned along a second side of the central axis of the microfluidic channel defined by the substrate, opposite the first side of the central axis. In this example, the uncoupled region may be aligned along the central axis of the microfluidic channel and is positioned between the first coupling region and the second coupling region In some implementations, the adhesive 200 can be applied to one or both of the microfluidic flow chamber 108 and transducer 109 and then patterned. The adhesive 200 can be patterned using stencil printing, screen printing, laser machining, die cutting, etching, or a combination thereof. In some implementations, the adhesive 200 can be a film adhesive that is patterned prior to being deposited on the microfluidic flow chamber 108 or transducer 109. The microfluidic flow chamber 108 or the transducer 109 can include alignment guides (e.g., fiducial markers or alignment pins) that enable the patterned film to be positioned correctly on the surface of the microfluidic flow chamber 108 or the transducer 109. The adhesive 200 can include at least one of a sugar, pectin, gelatin, agar, a hydrogel, glycerol, a wax, or polyethylene glycol. In some implementations the adhesive can be patterned when the transducer 109 is operated in a thickness mode. In some implementations, when the transducer 109 is operated in a bending mode, the adhesive is not patterned.

The method 1800 can include coupling the substrate with the transducer (BLOCK 1808). Also referring to FIGS. 2 and 3, among others, the substrate can form the microfluidic flow chamber 108. The microfluidic flow chamber 108 can be coupled to the transducer 109 with the adhesive 200. For example, the adhesive 200 can be applied to a surface of the transducer 109. The microfluidic flow chamber 108 can be deposited onto the adhesive 200. The microfluidic flow chamber 108 can be clamped to the transducer 109 as the adhesive 200 sets or is cured. In some implementations, the adhesive layer can be a pressure sensitive adhesive material. In some implementations, after the use of the acoustic separation device, the adhesive 200 can be dissolved with a solvent or heated to enable the microfluidic flow chamber 108 to be decoupled from the transducer 109.

In some implementations, the transducer 109 and the microfluidic flow chamber 108 can include alignment pins, alignment markings, or fiducial markers that enable alignment of the microfluidic channel 202 within the microfluidic flow chamber 108 with a displacement node of the transducer 109. For example, the method 1800 can include determine whether the microfluidic channel's symmetry axis should be aligned with the displacement node. The transducer 109 can include alignment pins that mate with holes in the microfluidic flow chamber 108. Mating of the pins can, in this example, align the microfluidic channel's symmetry axis with a displacement node of the transducer 109.

Figure 19C:
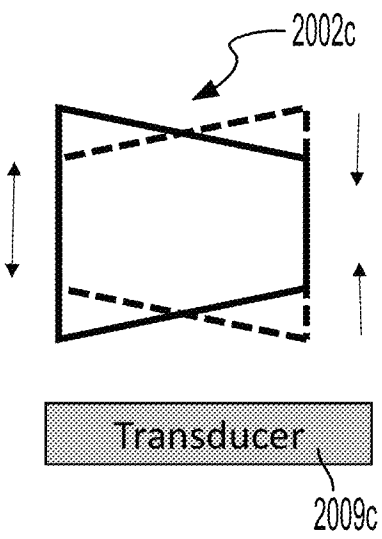
FIGS. 19A-19C illustrate example oscillatory modes of microfluidic channels excited by transducers.
Figure 19B:
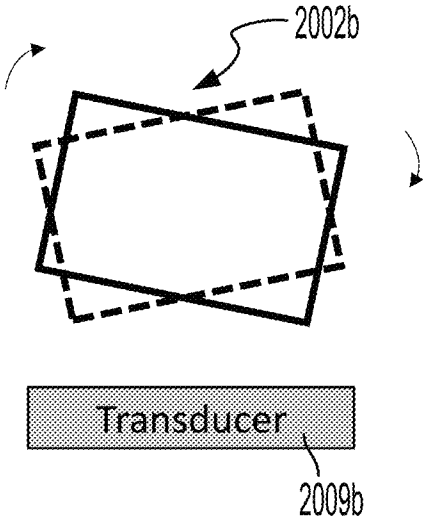
Figure 19A:
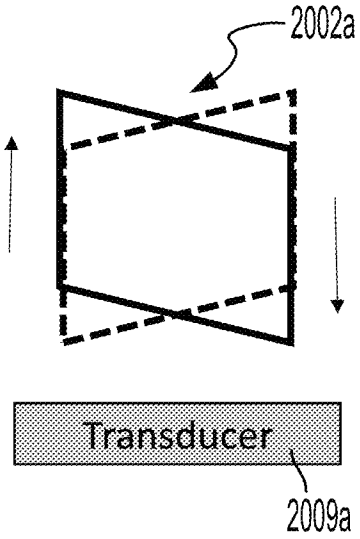

FIGS. 19A-19C illustrate example oscillatory modes of microfluidic channels 2002*a*-2002*c* (generally referred to as microfluidic channels 2002) excited by transducers 2009*a*-2009*c* (generally referred to as transducers 2009). For illustrative purposes, coupling material (e.g., an adhesive layer) that could be used to join the transducers 2009 with respective substrates in which the microfluidic channels 2002 are defined is not depicted in FIGS. 19A-19C. In addition, while the microfluidic channels 2002 are shown, the substrates in which they are defined are omitted for illustrative clarity.

The lines depicting the microfluidic channels 2002 in FIGS. 19A-19C represent the boundaries of the exterior channel walls. The solid lines depict a position of the microfluidic channels 2002 at maximum displacement for one phase of the oscillation, and the dashed lines depict a position of the microfluidic channels 2002 at maximum displacement for the opposite phase of the oscillation. The arrows represent the direction of oscillation. As shown, the example oscillatory modes shown in FIGS. 19A-19C can result in opposing walls of the microfluidic channels 2002 moving in generally opposing but parallel directions relative to one another, or in which one wall of the microfluidic channels 2002 is compressed while the opposing wall is extended. In some implementations, the example oscillatory modes of FIGS. 19A-19C can be referred to in this disclosure as rocking modes. Rocking modes may include, for example, a shear mode or a rotational mode, among others.

In some implementations, any of the systems described above can be configured or selected such that a transducer causes a microchannel to oscillate in a mode similar to the modes depicted in FIGS. 19A-19C. It should be understood that the maximum displacements depicted in FIGS. 19A-19C may be exaggerated for illustrative purposes, and that the relative channel dimension also are illustrative only and should be viewed as limiting the scope of the disclosure. In some implementations, any of the systems described in this disclosure may be configured or selected such that a transducer causes a microchannel to oscillate in different modes than those depicted in FIGS. 19A-19C (e.g., in a mode different from a rocking mode).

While operations are depicted in the drawings in a particular order, such operations are not required to be performed in the particular order shown or in sequential order, and all illustrated operations are not required to be performed. Actions described herein can be performed in a different order.

The separation of various system components does not require separation in all implementations, and the described program components can be included in a single hardware or software product.

Having now described some illustrative implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements and features discussed in connection with one implementation are not intended to be excluded from a similar role in other implementations or implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

As used herein, the term "about" and "substantially" will be understood by persons of ordinary skill in the art and will vary to some extent depending upon the context in which it is used. If there are uses of the term which are not clear to persons of ordinary skill in the art given the context in which it is used, "about" will mean up to plus or minus 10% of the particular term.

Any references to implementations or elements or acts of the systems and methods herein referred to in the singular may also embrace implementations including a plurality of these elements, and any references in plural to any implementation or element or act herein may also embrace implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation or embodiment, and references to "an implementation," "some implementations," "one implementation" or the like are not necessarily mutually exclusive and are intended to indicate that a particular feature, structure, or characteristic described in connection with the implementation may be included in at least one implementation or embodiment. Such terms as used herein are not necessarily all referring to the same implementation. Any implementation may be combined with any other implementation, inclusively or exclusively, in any manner consistent with the aspects and implementations disclosed herein.

The indefinite articles "a" and "an," as used herein in the specification and in the claims, unless clearly indicated to the contrary, should be understood to mean "at least one."

References to "or" may be construed as inclusive so that any terms described using "or" may indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Where technical features in the drawings, detailed description or any claim are followed by reference signs, the reference signs have been included to increase the intelligibility of the drawings, detailed description, and claims. Accordingly, neither the reference signs nor their absence has any limiting effect on the scope of any claim elements.

The systems and methods described herein may be embodied in other specific forms without departing from the characteristics thereof. The foregoing implementations are illustrative rather than limiting of the described systems and methods. Scope of the systems and methods described herein is thus indicated by the appended claims, rather than the foregoing description, and changes that come within the meaning and range of equivalency of the claims are embraced therein.

What is claimed:

1. A microfluidic system comprising:

a substrate comprising an elastic material and defining a microfluidic channel, the substrate having a first set of dimensions defining a thickness of a wall of the microfluidic channel and a second set of dimensions defining a width of the microfluidic channel; and a transducer mechanically coupled with the substrate, the transducer operated at a predetermined frequency different from a primary thickness resonant frequency of the transducer to excite the substrate in a predetermined oscillatory mode to impart an acoustic wave onto a fluid contained in the microfluidic channel defined by the substrate, wherein a thickness and a width of the transducer are selected based on the first set of dimensions defining the thickness of the wall of the microfluidic channel and the second set of dimensions defining the width of the microfluidic channel, such that the width of the transducer is between about two and about three times the width of the microfluidic channel, and the transducer resonates at about an excitation frequency of the microfluidic channel.

2. The system of claim 1, wherein the transducer is configured to form a displacement node at a first location along an axis parallel to a surface of the transducer, wherein a position of the first location is based on the thickness and the width of the transducer.

3. The system of claim 1, wherein the transducer is configured to form a plurality of displacement nodes at a plurality of locations along an axis parallel to a surface of the transducer.

4. The system of claim 1, wherein a symmetry axis of the microfluidic channel is aligned with a displacement node of the transducer.

5. The system of claim 1, wherein the wall is aligned with a displacement node of the transducer.

6. The system of claim 1, wherein the transducer is configured to form a displacement node at a first location based on at least one of the thickness or the width of the transducer.

7. The system of claim 1, wherein the system does not include a second transducer mechanically coupled with the substrate.

8. The system of claim 1, wherein the system does not include a rigid reflector aligned with a sidewall of the microfluidic channel.

9. The system of claim 1, further comprising an adhesive coupling a face of the substrate with the transducer.

10. The system of claim 9, wherein the adhesive is patterned to form a gap below a portion of the face of the substrate, wherein an edge of the gap is aligned with a symmetry axis of the microfluidic channel or with a sidewall of the microfluidic channel.

11. The system of claim 1, wherein a material of the transducer is selected based on the first set of dimensions defining the thickness of the wall of the microfluidic channel and the second set of dimensions defining the width of the microfluidic channel.

12. A microfluidic system comprising:

a substrate defining a microfluidic channel;

a transducer mechanically coupled with a portion of the substrate, the transducer configured to excite the substrate to impart an acoustic wave onto a fluid contained in the microfluidic channel defined by the substrate; and an adhesive layer to mechanically couple the transducer with the portion of the substrate, the adhesive layer patterned to define a coupling region that couples the transducer with the substrate and an uncoupled region in which a gap exists between the transducer and the substrate, wherein the coupling region is aligned along a first side of an axis of the microfluidic channel defined by the substrate and the uncoupled region is aligned along a second side of the axis of the microfluidic channel defined by the substrate, opposite the first side of the axis.

13. The system of claim 12, wherein the adhesive layer is patterned to define a shape selected based on a resonant mode of the substrate.

14. The system of claim 12, wherein the adhesive layer comprises at least one of a sugar, pectin, gelatin, agar, a hydrogel, glycerol, a wax, a tape, or a polyethylene glycol.

15. The system of claim 12, wherein the adhesive layer comprises a pressure sensitive adhesive material.

16. The system of claim 12, wherein the adhesive layer is patterned using at least one of stencil printing, screen printing, laser machining, or die cutting.

17. The system of claim 12, further comprising at least one alignment pin positioned on at least one of the substrate or the transducer, the alignment pin configured to align the substrate with respect to the transducer.

18. A microfluidic system comprising:

a substrate defining a microfluidic channel;

a transducer mechanically coupled with a portion of the substrate, the transducer configured to excite the substrate to impart an acoustic wave onto a fluid contained in the microfluidic channel defined by the substrate; and an adhesive layer to mechanically couple the transducer with the portion of the substrate, the adhesive layer patterned to define a coupling region that couples the transducer with the substrate and an uncoupled region in which a gap exists between the transducer and the substrate, wherein the coupling region comprises a first coupling region aligned along a first side of an axis of the microfluidic channel defined by the substrate and a second coupling region aligned along a second side of the axis of the microfluidic channel defined by the substrate, opposite the first side of the axis, and the uncoupled region is aligned along the axis of the microfluidic channel and is positioned between the first coupling region and the second coupling region.

19. A method comprising:

defining a microfluidic channel in a substrate comprising an elastic material, the substrate having a first set of dimensions defining a thickness of a wall of the microfluidic channel;

selecting a transducer to operate at a predetermined frequency different from a primary thickness resonant frequency of the transducer to excite the substrate in a predetermined oscillatory mode to impart an acoustic wave onto a fluid contained in the microfluidic channel defined by the substrate, wherein a thickness and a width of the transducer are selected based on the first set of dimensions defining the thickness of the wall of the microfluidic channel, such that the width of the transducer is between about two and about three times the width of the microfluidic channel, and the transducer resonates at about an excitation frequency of the microfluidic channel; and coupling at least a portion of the substrate with a surface of the transducer.

* * * * *